US006228556B1

(12) United States Patent
Asami et al.

(10) Patent No.: US 6,228,556 B1
(45) **Date of Patent: *May 8, 2001**

(54) SILVER HALIDE COLOR PHOTOGRAPHIC LIGHT-SENSITIVE MATERIAL AND COLOR IMAGE FORMATION METHOD USING THE SAME

(75) Inventors: Masahiro Asami; Kazuhiko Matsumoto; Toshiki Taguchi, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/827,253

(22) Filed: Mar. 28, 1997

(30) Foreign Application Priority Data

Mar. 28, 1996 (JP) ..... 8-097344

(51) Int. Cl.[7] ..... G03C 8/36; G03C 1/035
(52) U.S. Cl. ..... 430/203; 430/567; 430/571
(58) Field of Search ..... 430/203, 206, 430/404, 351, 567, 571

(56) References Cited

U.S. PATENT DOCUMENTS

| | | | | |
|---|---|---|---|---|
| 4,021,240 | * | 5/1977 | Cerquone et al. | 430/203 |
| 5,089,378 | * | 2/1992 | Ozaki et al. | 430/351 |
| 5,264,337 | * | 11/1993 | Maskasky | 430/567 |
| 5,316,886 | * | 5/1994 | Koide et al. | 430/203 |
| 5,652,089 | * | 7/1997 | Saitou | 430/567 |
| 5,667,945 | * | 9/1997 | Takeuchi et al. | 430/351 |
| 5,677,104 | * | 10/1997 | Hirai et al. | 430/203 |
| 5,698,365 | * | 12/1997 | Taguchi et al. | 430/203 |
| 5,716,772 | * | 2/1998 | Taguchi | 430/351 |
| 5,747,226 | * | 5/1998 | Nakamura et al. | 430/404 |
| 5,756,269 | * | 5/1998 | Ishikawa et al. | 430/351 |
| 5,780,210 | * | 7/1998 | Takeuchi et al. | 430/435 |
| 5,843,628 | * | 12/1998 | Taguchi et al. | 430/203 |
| 5,908,736 | * | 6/1999 | Yamazaki | 430/203 |

FOREIGN PATENT DOCUMENTS 62-201434 * 9/1987 (JP) .
1-167743 * 7/1989 (JP) .

OTHER PUBLICATIONS

Patent & Trademark Office English– Language Translation Of Japanese Patent 62–201434 (Pub. Sep. 5, 1987).*
Derwent Abstract ACC–No. 1987–288303 of Japanese Patent 62–201434 (Pub Sep. 5, 1987).*
Patent & Trade Office English– Language Translation of JP 1–167743 (Pub 7/1989).*
Japio Abstract 89–167743 of JP 01167743 (Pub 7/1989).*

* cited by examiner

*Primary Examiner*—Janis L. Dote
(74) *Attorney, Agent, or Firm*—Sughrue, Mion, Zinn, Macpeak & Seas, PLLC

(57) ABSTRACT

Disclosed is a silver halide color photographic light-sensitive material which is capable of forming an image by: after exposing a light-sensitive material, which comprises a first support having thereon at least one photographic light-sensitive layer comprising a light-sensitive silver halide emulsion, a developing agent, a compound capable of forming a dye upon coupling reaction with an oxidation product of the developing agent and a binder; attaching said light-sensitive material to a processing material, which comprises a second support having thereon a base and/or a base precursor, in such a way that the coated surfaces of the two materials faced each other, in the presence of a small amount of water which corresponds to from 1/10 to 1 time water necessary for giving maximum swelling of all coated layers constituting the light-sensitive material and the processing material; and then heating the light-sensitive material and the processing material, wherein at least one said light-sensitive layer contains an emulsion having silver halide grains having a silver chloride content of 50 mol % or more, wherein the silver halide grains are tabular grains having (i) a main outer surface constituted by (100) faces, (ii) having a rectangular shape with adjacent major face (projection plane) edge ratios being from 1:1 to 1:2, and (iii) having an aspect ratio of 2 or more.

2 Claims, No Drawings

SILVER HALIDE COLOR PHOTOGRAPHIC LIGHT-SENSITIVE MATERIAL AND COLOR IMAGE FORMATION METHOD USING THE SAME

FIELD OF THE INVENTION

The present invention relates to a novel silver halide color photographic light-sensitive material for recording an image and a method for forming a color image using the same.

BACKGROUND OF THE INVENTION

Photographic light-sensitive materials using silver halide are more and more expanding in recent years and at present, a high-quality color image can be easily obtained. For example, in a system usually called a color photograph, photographing is performed using a color negative film and the image information recorded on the color negative film after development is optically printed on a color paper to obtain a color print. Recently, this process has advanced to a higher level so that a color lab as a large-scale centralized base for producing a large quantity of color prints in high efficiency or a so-called mini lab as a compact and simple printer processor installed at a shop is popularized, and as a result, anybody can easily enjoy color photographs.

The color photograph currently popularized has a principle of using color reproduction according to a subtractive color process. A general color negative film comprises a transparent support having provided thereon light-sensitive layers using silver halide emulsions as light-sensitive elements imparted with spectral sensitivity in blue, green and red regions, respectively, each light-sensitive layer containing in combination a so-called color coupler which forms a yellow, magenta or cyan dye as a hue to come to a complementary color. After imagewise exposure by photographing, the color negative film is developed in a color developer containing an aromatic primary amine developing agent. At this time, exposed silver halide grains are developed, namely, reduced by the developing agent and the oxidation product of the developing agent, which is simultaneously produced, causes coupling reaction with the above-described color coupler and thereby each dye is formed. Metal silver (developed silver) generated on development and unreacted silver halide are removed by bleaching and fixing, respectively, to obtain a dye image. Through the thus processed color negative film, a color printing paper as a color light-sensitive material comprising a reflective support having provided thereon light-sensitive layers each having the same combination of sensitive wavelength region with colored hue is optically exposed and then subjected similarly to color development, bleaching and fixing, and thereby a color print comprising a dye image reproducing the scene of an original can be obtained.

The above-described system is widely popularized at present, however, demands for further simplicity are more and more increasing. First, processing baths for performing color development, bleaching and fixing need be precisely controlled on the composition and the temperature and therefore, professional knowledge and skilled operation are required; second, the processing solutions contain materials restricted in the discharge in view of environmental conservation, such as a color developing agent and an iron chelate compound bleaching agent, and therefore, facilities for exclusive use are required in many cases for installing equipments such as a developing machine; and third, although the processing time is reduced by the technical development in recent years, time needs be spent on the above-described development processing and accordingly, the demand for rapid reproduction of a recording image cannot be satisfactorily met.

Under these circumstances, a large number of improved techniques have been proposed. In particular, in order to achieve simple and rapid development, various techniques using a so-called high silver chloride emulsion having a high silver iodide content have been proposed. By using a high silver chloride emulsion, the development rate is accelerated and at the same time, capability of reuse of the processing solution advantageously increases. Accordingly, the light-sensitive material for printing such as color printing paper which are predominantly used in recent years uses a high silver chloride emulsion.

As a technique of applying the advantage of rapid developability inherent to the high silver chloride emulsion to the light-sensitive material for photographing, U.S. Pat. Nos. 5,264,337, 5,292,632 and 5,310,635 and WO94/22054 disclose a technique of using a tabular, high silver chloride emulsion constituted by (100) faces in the light-sensitive material for photographing. By using the high silver chloride emulsion, high development rate can be achieved and at the same time, there is provided an advantage such that the light-sensitive material for photographing and the light-sensitive material for printing can be processed using the same processing solution.

However, as described in the above-described patent publications, various problems arise due to the development characteristics of the high silver chloride emulsion. First, if good granularity is intended to obtain, development of grains after initiation of development must be inhibited on the way, but since individual grains of the high silver chloride emulsion have high development rate, the development initiation time is liable to be uneven among the exposed grains and high-sensitive photographic response can hardly be obtained at the initiation stage of development. Second, if high developability of the high silver chloride emulsion is intended to use, graininess is readily worsened, accordingly, to achieve properties required for the photographic material for camera work, such as wide exposure latitude and excellent graininess, using the high silver chloride emulsion is highly difficult in view of technical point and this is not yet overcome by the techniques described in the above-described publications. Thus, a large number of principle problems are remaining in achieving a light-sensitive material for photographing using the high silver chloride emulsion.

Apart from these attempts, a technique of constructing a system not using a color developing agent and a bleaching agent which are used in the current color image formation system, thereby lightening the load on the environment and improving simplicity, has been reported. For example, *IS & T's 48th Annual Conference Proceedings*, page 180, discloses a system dispensable with the bleach-fixing bath which is indispensable in conventional color photographic processing, where a dye produced on development reaction is moved to a mordanting layer and then, the layer is peeled off to remove developed silver or unreacted silver halide. However, in the technique proposed here, development processing in a processing bath containing a color developing agent is still necessary and the environmental issue can be hardly overcome.

As a system not using a processing solution containing a color developing agent, a Pictrography system has been proposed by Fuji Photo Film Co., Ltd. In this system, a slight amount of water is fed to a light-sensitive material containing a base precursor, laminating it to an image-receiving material, and these are heated to cause development reaction. This system is advantageous in view of environmental issue because the above-described processing bath is not used. However, this system is intended to use in fixing the image formed to a dye fixing layer and viewing it as a dye image, and therefore, a system usable as a recording material for photographing has been demanded.

SUMMARY OF THE INVENTION

A first object of the present invention is to provide a light-sensitive material for photographing, capable of rapid image formation reduced in the load on environment.

A second object of the present invention is to provide an excellent color photographic light-sensitive material capable of giving good graininess and wide exposure latitude even in simple and rapid processing.

The above-described objects of the present invention can be effectively attained by the following constructions:

1) a silver halide color photographic light-sensitive material comprising a support having thereon a photographic constituent layer containing at least one photographic light-sensitive layer comprising a light-sensitive silver halide, a developing agent, a compound capable of forming a dye upon coupling reaction with an oxidation product of the developing agent and a binder, which forms an image by, after exposure of the light-sensitive material, supplying water corresponding to from 1/10 to 1 times the water necessary for giving maximum swelling of all coated layers of the light-sensitive material and a processing material to the light-sensitive material or the processing material, laminating these materials to each other and then heating them, the processing material comprising a support having thereon a constituent layer containing a processing layer containing a base and/or a base precursor, wherein at least one light-sensitive layer contains an emulsion comprising silver halide grains having a silver chloride content of 50 mol % or more and the grain is a tabular grain having a main outer surface constituted by (100) faces, having a rectangular shape with a length/width ratio of its projection plane being from 1:1 to 1:2 (having a rectangular shape with adjacent major face (projection plane) edge ratios being from 1:1 to 1:2), and having an aspect ratio of 2 or more;

2) silver halide color photographic light-sensitive material as described in item 1), wherein at least two kinds of silver halide emulsions having spectral sensitivity in the same wavelength region and different in the average grain projected area are contained as the silver halide emulsion and the emulsion having a larger average grain projected area has a ratio of silver halide grain numbers per unit area of the light-sensitive material larger than the ratio of the values obtained by dividing the coated silver amount of the emulsion by the 3/2nd power of average grain projected area;

3) a silver halide color photographic light-sensitive material as described in item 1) or 2), wherein the developing agent is a compound represented by the following formula I, II, III or IV:

I

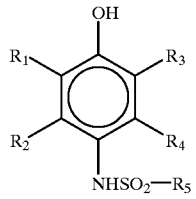

II

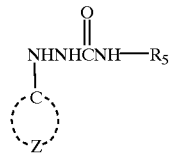

III

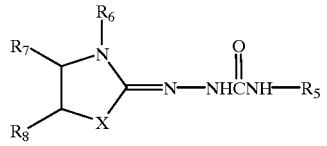

IV

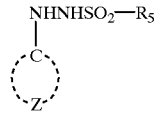

wherein $R_1$, $R_2$, $R_3$ and $R_4$ each represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group, $R_5$ represents an alkyl group, an aryl group or a heterocyclic group, Z represents an atomic group necessary for forming a (hetero) aromatic ring and when Z is a benzene ring, the sum of the Hammett's constants (σ) of the substituents thereof is 1 or more, $R_6$ represents an alkyl group, X represents an oxygen atom, a sulfur atom, a selenium atom or an alkyl-substituted or aryl-substituted tertiary nitrogen atom, $R_7$ and $R_8$ each represents a hydrogen atom or a substituent and $R_7$ and $R_8$ may be combined to each other to form a double bond or a ring, and the compounds represented by formulae I to IV each contains at least one ballast group having 8 or more carbon atoms so as to impart oil solubility to the molecule; and 4) a method for forming a color image comprising imagewise exposing a silver halide light-sensitive material described in item 1), 2) or 3) used as a light-sensitive material, supplying water corresponding to from 1/10 to 1 times the total of the water amount necessary for giving maximum swelling of a light-sensitive material and a processing material to the light-sensitive material or the processing material, laminating (attaching) these materials to each other and then heating them at a temperature of from 60 to 100° C. for from 5 to 60 seconds.

DETAILED DESCRIPTION OF THE INVENTION

In the present invention, at least one light-sensitive layer contains an emulsion comprising silver halide grains having a silver chloride content of 50 mol % or more and the grain is a tabular grain having a main outer surface constituted by (100) faces, having a rectangular shape with a length/width ratio of its projection plane being from 1:1 to 1:2 (having a rectangular shape with adjacent major face (projection plane) edge ratios being from 1:1 to 1:2), and having an aspect ratio of 2 or more. It suffices if 50% or more of the projected area of silver halide grains contained in the emulsion satisfy the above-described requirement, and it is preferred that 70% or more of the projected area satisfy this requirement.

The term "aspect ratio" as used in the present invention means a value obtained by dividing the diameter of a circle having the same area as the projected area of a grain by the grain thickness. In the silver halide grain of the present invention, the main outer surface of a grain is constituted by (100) faces and therefore, its projection plane has a rectangular shape. In this case, the ratio of the length side to the width side of the rectangle as a projected area must be in the range between 1:1 and 1:2. In other words, if an emulsion comprising stick or nearly cubic grains of rectangular parallelopiped is used, the effects of the present invention cannot be obtained. A tabular grain of which projected area is closer to a square is preferred.

The shape of the silver halide grain can be measured by observing the silver halide grain together with a latex ball for reference used as a standard of the size through an electron microscope by a carbon replica method of simultaneously shadowing them with a heavy metal or the like.

The emulsion for use in the present invention has a halogen composition of silver chlorobomide, silver chloroiodide, silver chloroiodobromide or silver chloride having a silver chloride content of 50 mol % or more. The emulsion of the present invention may contain silver iodide, however, the silver iodide content is preferably 6 mol % or less, more preferably 2 mol % or less. A silver halide emulsion comprising grains having in the inside of the silver halide grain a laminate structure consisting of a plurality of layers different in the halogen composition may also be preferably used.

The size of the silver halide grain for use in the present invention is, in terms of a diameter of a circle equal to the projected area, preferably from 0.1 to 10 $\mu$m, more preferably from 0.3 to 5 $\mu$m, still more preferably from 0.5 to 4 $\mu$m.

The emulsion for use in the present invention comprising silver halide grains having a silver chloride content of 50 mol % or more, which are a tabular grain having a main outer surface constituted by (100) faces, having a rectangular shape with a length/width ratio of its projection plane being from 1:1 to 1:2 (having a rectangular shape with adjacent major face (projection plane) edge ratios being from 1:1 to 1:2), and having an aspect ratio of 2 or more, may be prepared by various methods including known methods. For example, the methods described in JP-A-5-204073 (the term "JP-A" as used in the present invention means an "unexamined published Japanese patent application"), JP-A-51-88017, JP-A-63-24238 and Japanese Patent Application No. 5-264059 (corresponding to JP-A-7-146522), may be freely used.

In preparing the tabular grain of the present invention, the method of producing a speck to grow tabular is a point. As described in the production methods of the above-described publications, to add iodide ions or bromide ions at the initial stage of grain formation or to add a compound which selectively adsorbs to a specific face is useful.

The dispersion medium used at the nucleation, the ripening or the growing may be a conventionally known dispersion medium for AgX emulsions, however, gelatin having a methionine content of preferably from 0 to 50 $\mu$mol/g, more preferably from 0 to 30 $\mu$mol/g is preferably used. When this gelatin is used in the ripening or the growing, thin tabular grains uniform in the diameter size distribution are advantageously formed. Further, synthetic polymers described in JP-B-52-16365 (the term "JP-B" as used herein means an "examined Japanese patent publication"), *Nippon Shashin Gakkai Shi* (*Journal of Japan Photographic Association*), Vol. 29 (1), 17, 22 (1966), ibid., Vol. 30 (1), 10, 19 (1967), ibid., Vol. 30 (2), 17 (1967), and ibid., Vol. 33 (3), 24 (1967) may be preferably used as the dispersion medium. The pH at the growing by addition of fine grains needs be 2.0 or more, however, it is preferably from 3 to 10, more preferably from 4 to 9.

The pCl needs be 1.0 or more, however, it is preferably 1.6 or more, more preferably from 2.0 to 3.0.

The above-described conditions in growing are particularly preferred in forming a tabular grain having main planes (major faces) of (100) face.

The pCl as used herein is defined by the following formula based on the activity $[Cl^-]$ of Cl ions in the solution:

$$pCl=-\log[Cl^-]$$

and this is described in detail in T. H. James, *The Theory of the Photographic Process*, 4th ed., Chap 1.

If the pH is less than 2.0, for example, in the case of a tabular grain having main plains of (100) face, the growth in the width direction is suppressed to reduce the aspect ratio and as a result, the covering power of the emulsion is liable to decrease and at the same time, the sensitivity is lowered. If the pH exceeds 2.0, the growth rate in the width direction increases and as a result, an emulsion having a high aspect ratio and a high covering power can be obtained, however, fog is high and sensitivity is liable to lower.

If the pCl is less than 1.0, the growth in the length direction is accelerated to reduce the aspect ratio and as a result, the covering power of the emulsion is low and at the same time, the sensitivity is lowered. If the pCl exceeds 1.6, the aspect ratio becomes high and the covering power increases, however, fog is high and sensitivity is liable to lower. At this time, when the base grain is grown from a silver halide fine grain, even if the pH exceeds 6 and/or the pCl exceeds 1.6, low fog, high sensitivity and high covering power with a high aspect ratio can be obtained.

With respect to the monodispersibility of the emulsion of the present invention, the monodispersity is, in terms of the coefficient of variation defined by the method described in JP-A-59-745481, preferably 30% or less, more preferably from 5 to 25%. In the case where the emulsion is used for a high-contrast light-sensitive material, the monodispersity is preferably 5 to 15%.

The light-sensitive material of the present invention is constructed by providing on a support a photographic constituent layer containing at least one photographic light-sensitive layer comprising a light-sensitive silver halide, a developing agent, a compound capable of forming a dye upon coupling reaction with an oxidation product of the developing agent and a binder.

After imagewise exposure of the light-sensitive material, color development is performed to form an image, where water corresponding to from 1/10 to 1 times the water necessary for giving maximum swelling of all coated layers of the light-sensitive material after exposure and the processing material containing a base and/or a base precursor on its support, is supplied to the light-sensitive material or the processing material, and these materials are laminated (attached) and then heated.

U.S. Pat. No. 5,264,337 (supra), U.S. Pat. Nos. 5,292,632 and 5,310,635 and WO94/22054 disclose a tabular, high silver chloride emulsion constituted by (100) faces, however, when this is processed in a usual liquid development system using a color developing bath containing an aromatic primary amine developing agent, the state of grains in the emulsion is extremely lower than the level required for the light-sensitive material for photographing.

JP-A-7-120014 discloses a technique of heat developing a light-sensitive material containing silver halide grains comprising (100) faces with the length of one side being 2 times or more, or 0.5 times or less the arithmetic mean of the lengths of other two sides, however, this is a technique for reducing fog at the time of heat development of a light-sensitive material for printing using silver bromide or silver chlorobromide emulsion, and as is seen from the photograph of grains attached to the patent specification, the silver halide grain has a rectangular parallelopiped shape and different from the shape of the tabular grain specified in the present invention, thus, this is a different technique from the present invention.

When a light-sensitive material containing a tabular, high silver chloride emulsion constituted by (100) faces and a developing agent is color developed by the development method specified in the present invention, the excellent graininess required for the photographic material for camera work can first be achieved while maintaining rapid developability of the high silver chloride emulsion.

In the present invention, a light-sensitive material for use in recording a scene of an original and reproducing it as a color image may be constructed fundamentally using color reproduction by subtractive color process. More specifically, the color information of an original scene can be recorded by providing at least three light-sensitive layers having spectral sensitivity in the blue, green and red regions and incorporating into each light-sensitive layer a color coupler capable of forming a yellow, magenta or cyan dye having a complementary relation to the sensitive wavelength region of the layer itself. Through the thus-obtained dye image, a color printing paper having the same relation between the sensitive wavelength and the colored hue is exposed and thereby, the scene of an original can be reproduced. Further, the information of a dye image obtained by photographing a scene of an original may be read by a scanner or the like to reproduce the information as an image for viewing.

The light-sensitive material of the present invention may be constructed by providing light-sensitive layers having spectral sensitivity in three or more wavelength regions.

Further, the sensitive wavelength region and the colored hue may have a relation therebetween other than the complementary relation. In such a case, after taking in the above-described image information, image processing such as hue conversion may be applied to reproduce the color information of an original.

In the present invention, at least two kinds of silver halide emulsions having spectral sensitivity in the same wavelength region and different in the average grain projected area are preferably contained. The term "having spectral sensitivity in the same wavelength region" as used in the present invention means to have spectral sensitivity in effectively the same wavelength region. Accordingly, when emulsions slightly different in the spectral sensitivity distribution are overlapped in the main spectral-sensitive region, they are regarded as the emulsions having spectral sensitivity in the same wavelength region.

In the present invention, a plurality of emulsions having spectral sensitivity in the same wavelength region and different in the average grain projected area can be used in different light-sensitive layers separately for respective emulsions or the plurality of emulsions may be mixed and w incorporated into same light-sensitive layer.

At this time, it is preferred to use these emulsions such that the difference in the average grain projected area of at least 1.25 times is present between emulsions. The difference is more preferably 1.4 times or more, most preferably 1.6 times or more. In the case where three or more kinds of emulsions are used, the above-described relation is preferably present between the emulsion having a smallest average grain projected area and the emulsion having a largest average grain projected area.

In the present invention, a plurality of emulsions having spectral sensitivity in the same wavelength region and different in the average grain projected area may be incorporated by providing separate light-sensitive layers every emulsions or by mixing the plurality of emulsions in one light-sensitive layer.

When these emulsions are contained in separated layers, the emulsion having a larger average grain projected area is preferably disposed as an upper layer (a position closer to the light entering direction).

When these emulsions are contained in separate light-sensitive layers, the color couplers to be combined therewith preferably have the same hue, however, couplers of forming color in different hues may be mixed to give different colored hues to respective light-sensitive layers or couplers different in the absorption profile of the colored hue may be used in respective light-sensitive layers.

In the present invention, these emulsions having spectral sensitivity in the same wavelength region are preferably coated to have a construction such that an emulsion having a larger average grain projected area has a ratio of silver halide grain numbers per unit area of the light-sensitive material larger than the ratio of the values obtained by dividing the coated silver amount of the emulsions by the 3/2nd power of average grain projected area.

That is, the light-sensitive material for use in the present invention comprises at least two kinds of silver halide emulsion having spectral sensitivity in the same wavelength region and different in the average grain projected area, and said at least two silver halide emulsions satisfies the following relationship:

$$\frac{C_2}{C_1} > \frac{(D_2/E_2^{3/2})}{(D_1/E_1^{3/2})}$$

wherein $C_1$ and $C_2$ represents numbers of silver halide grains having a smaller average grain projected area and a larger average grain projected area, respectively, per unit area of the light-sensitive material; $D_1$ and $D_2$ represents coated silver halide amounts of silver halide grains having a smaller average grain projected area and a larger average grain projected area, respectively, per unit area of the light-sensitive material; and $E_1$ and $E_2$ represents average grain projected areas of silver halide grains having a smaller average grain projected area and a larger average grain projected area, respectively, per unit area of the light-sensitive material.

More specifically, assuming that (i) emulsion a is an emulsion having the smallest average grain projected area, and emulsions b, c, . . . increase their average grain projected areas in this order; (ii) Ka, Kb, Kc . . . are a number of silver halide grains per unit of emulsions a, b, c, . . . , respectively, and Pa, Pb, Pc, . . . are a ratio of Ka, Kb, Kc, . . . , to Ka, respectively (Pa=1); and (iii) Ha, Hb, Hc, . . . are a ratio of the value obtained by dividing the coated silver amount of emulsions a, b, c, . . . by the $3/2^{nd}$ power of average grain projected area of emulsions a, b, c, . . . , respectively, and Qa, Qb, Qc, . . . are a ratio of Ha, Hb, Hc, . . . , to Ha, respectively (Qa=1), "the larger the average grain projected area of an emulsion is, the larger the ratio of P to Q is" means that the ratio of Pb to Qb (>1) is larger than the ratio of Pa to Qa (=1) and that the ratio of Pc to Qc is larger than the ratio of Pb to Qb. That is, the relationship: . . . >Pc/Qc>Pb/Qb>Pa/Qa is satisfied in the present invention.

In other words, "the larger the average grain projected area of an emulsion, the larger the ratio of P to Q is" means that in emulsion n (n=1 to i; i≧2; the larger n is, the larger the average grain projected area of the emulsion n is), any emulsions k and m (1≦k≦i, 1≦m<i, k>m) satisfy the relationship: Pk/Qk>Pm/Qm.

By having such a construction, an image having good graininess can be obtained even under the development condition of heating at a high temperature and also, high developing property and wide exposure latitude can be satisfactorily achieved at the same time.

In a color negative film conventionally used in taking a photograph, a technique of, for example, using a so-called DIR coupler which releases a development inhibiting compound upon coupling reaction with an oxidation product of the developing agent, is used. In the light-sensitive material of the present invention, excellent granularity can be obtained even when the DIR coupler is not used, and if the DIR coupler is combined, further excellent granularity is obtained.

The light-sensitive material of the present invention is, after exposure, developed by supplying water corresponding to from 1/10 to 1 times the water necessary for giving maximum swelling of all coated layers constituting the light-sensitive material and the processing material, laminating on a processing material containing a base and/or a base precursor, and heating the materials.

The present invention has an object of achieving good graininess and wide exposure latitude in the above-described heat development and is intended to lighten the load on environment to be imposed in liquid development. However, the light-sensitive material of the present invention may be developed by an activator method using an alkali processing solution or with a processing solution containing a developing agent and a base to form an image.

In the present invention, image information may be taken in without removing developed silver generated by the development or undeveloped silver halide, however, an image may be taken in after removing them. In the latter case, a means for removing them simultaneously with or after the development may be used.

In order to remove developed silver in the light-sensitive material simultaneously with development, to convert silver halide into a complex or to solubilize silver halide, the processing material may contain an oxidizing agent for silver or a rehalogenating agent, which acts as a bleaching agent, or a silver halide solvent which acts as a fixing agent, so that it can cause reaction on heat development.

Further, a second material containing an oxidizing agent for silver, a rehalogenating agent or a silver halide solvent may be laminated on the light-sensitive material after completion of development in the image formation, to remove developed silver, to convert silver halide into a complex or to solubilize silver halide.

In the present invention, the above-described treatment is preferably applied to such a degree that no obstacle arises to the reading of image information after photographing and development in the subsequent image formation. In particular, undeveloped silver halide generates high haze in the gelatin layer to increase the background density of an image and therefore, the above-described complex forming agent is preferably used to reduce haze or solubilize and then remove wholly or partly the undeveloped silver halide from the layer.

When used an emulsion specified in the present invention comprising silver halide grains having a silver chloride content of 50 mol % or more, the grain being a tabular grain where the main outer surface is constituted by (100) faces and the length of the shortest side out of three kinds of sides defining the grain outer shape and intersecting at a right angle with each other is 0.5 or less of the average of the lengths of other two sides, the above-described haze can be outstandingly reduced.

The silver halide emulsion which can be used in combination with the silver halide emulsion of the present invention may be selected from the silver halide emulsions prepared by the methods described, specifically, in U.S. Pat. No. 4,500,626 (column 50) and U.S. Pat. No. 4,628,021, Research Disclosure (hereinafter simply referred to as RD) No. 17029 (1978), ibid., No. 17643 (December 1978), pages 22 to 23, ibid., No. 18716 (November 1979), page 648, ibid., No. 307105 (November 1989), pages 863 to 865, JP-A-62-253159, JP-A-64-13546, JP-A-2-236546, JP-A-3-110555, P. Glafkides, Chimie et Phisigue Photographique, Paul Montel (1967), G. F. Duffin, Photographic Emulsion Chemistry, The Focal Press (1966) and V. L. Zelikman et al, Making and Coating Photographic Emulsion, The Focal Press (1964).

In the process of preparing the light-sensitive silver halide emulsion of the present invention, so-called desilvering for removing excessive salts is preferably performed. As a means therefor, a noodle washing method of performing desilvering by gelling gelatin or a precipitation method using an inorganic salt comprising a polyvalent anion (e.g., sodium sulfate), an anionic surface active agent, an anionic polymer (e.g., sodium polystyrenesulfonate) or a gelatin derivative (e.g., aliphatic acylated gelatin, aromatic acylated gelatin, aromatic carbamoylated gelatin) may be used. A precipitation method is preferably used.

The light-sensitive silver halide emulsion for use in the present invention may contain for various purposes a heavy metal such as iridium, rhodium, platinum, cadmium, zinc, thallium, lead, iron and osmium. These compounds may be used individually or in combination of two or more thereof. The addition amount varies depending on the use purpose, however, it is generally on the order of from $10^{-9}$ to $10^{-3}$ mol per mol of silver halide. The heavy metal may be incorporated uniformly into the grain or may be localized in the inside or on the surface of the grain. Specifically, emulsions described in JP-A-2-236542, JP-A-1-11637 and Japanese Patent Application No. 4-126629 (corresponding to JP-A-5-181246) are preferably used.

At the stage of forming grains of the light-sensitive silver halide emulsion of the present invention, a rhodanate, an ammonia, a tetra-substituted thiourea compound, an organic thioether derivative described in JP-B-47-11386 or a sulfur-containing compound described in JP-A-53-144319 may be used as a silver halide solvent.

With respect to other conditions, description in P. Glafkides, Chimie et Phisigue Photographique, Paul Montel (1967), G. F. Duffin, Photographic Emulsion Chemistry, The Focal Press (1966) and V. L. Zelikman et al, Making and Coating Photographic Emulsion, The Focal Press (1964) may be referred to. More specifically, any of an acid process, a neutral process and an ammonia process may be used, and as a method of reacting a soluble silver salt with a soluble halogen salt, any of a single jet method, a double jet method and a combination thereof may be used. In order to obtain a monodisperse emulsion, a double jet method is preferably used.

A reverse mixing method of forming grains in excessive silver ions may be used. A so-called controlled double jet method, which is one form of the double jet method, of keeping constant the pAg of the liquid phase where the silver halide is formed may also be used.

Further, in order to accelerate growth of grains, the concentration, the amount or the addition rate of silver salt and halogen salt added may be increased (see, JP-A-55-142329, JP-A-55-158124, U.S. Pat. No. 3,650,757).

The reaction solution may be stirred by any known stirring method. The temperature and the pH of the reaction solution during formation of silver halide grains may be freely selected depending on the purpose. The pH is preferably from 2.2 to 7.0, more preferably from 2.5 to 6.0.

The light-sensitive silver halide emulsion is usually a silver halide emulsion subjected to chemical sensitization. In the chemical sensitization of the light-sensitive silver halide emulsion for use in the present invention, chalcogen sensitization such as sulfur sensitization, selenium sensitization and tellurium sensitization, noble metal sensitization using gold, platinum or palladium, and reduction sensitization, which are all known to the emulsion for normal type light-sensitive materials, may be used individually or in combination (see, for example, JP-A-3-110555 and Japanese Patent Application No. 4-75798 (corresponding to JP-A-241267)). The chemical sensitization may also be performed in the presence of a nitrogen-containing heterocyclic compound (see, JP-A-62-253159). Further, an antifoggant which will be described later, may be added after completion of the chemical sensitization. Specifically, the methods described in JP-A-5-45833 and JP-A-62-40446 may be used.

At the time of chemical sensitization, the pH is preferably from 5.3 to 10.5, more preferably from 5.5 to 8.5, and the pAg is preferably from 6.0 to 10.5, more preferably from 6.8 to 9.0.

The light-sensitive silver halide for use in the present invention is coated in an amount of, in terms of silver, from 1 $mg/m^2$ to 10 $g/m^2$.

The light-sensitive silver halide emulsion for use in the present invention may be spectrally sensitized by a methine dye or the like so that the light-sensitive silver halide emulsion can have spectral sensitivity such as green sensitivity and red sensitivity. Further, spectral sensitization in the blue region may be applied to the blue-sensitive emulsion, if desired.

Examples of the dye used therefor include a cyanine dye, a merocyanine dye, a complex cyanine dye, a complex merocyanine dye, a holopolar cyanine dye, a hemicyanine dye, a styryl dye and a hemioxonol dye.

Specific examples thereof include the sensitizing dyes described in U.S. Patent 4,615,257, JP-A-59-180550, JP-A-64-13546, JP-A-5-45828 and JP-A-5-45834.

These sensitizing dyes may be used individually or in combination and the combination of sensitizing dyes is often used for the purpose of supersensitization or for controlling the wavelength of spectral sensitization.

In combination with a sensitizing dye, a dye which itself has no spectral sensitization effect or a material which absorbs substantially no visible light, but which exhibits supersensitization, may be contained in the emulsion (those described, for example, in U.S. Pat No. 3,615,641 and JP-A-63-23145).

The spectral sensitizing dye may be added to the emulsion before, during or after chemical sensitization or according to U.S. Pat. Nos. 4,183,756 and 4,225,666, may be added before or after nucleation of silver halide grains. The sensitizing dye or the supersensitizing dye may be added as a solution in an organic solvent such as methanol, a dispersion, for example, in gelatin, or a one-part solution with a surface active agent. The addition amount is generally on the order of from $10^{-8}$ to $10^{-2}$ mol per mol of silver halide.

The additives for use in these processes and known photographic additives which can be used in the present invention are described in RD, No. 17643, ibid., No. 18716 and ibid., No. 307105, and the pertinent portions are summarized in the table below.

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.-p. 649, right col. | pp. 866–868 |
| 4. Whitening agent | p. 24 | p. 648, right col. | p. 868 |
| 5. Antifoggant, stabilizer | pp. 24–25 | p. 649, right col. | pp. 868–870 |
| 6. Light absorbent, filter dye, UV absorbent | pp. 25–26 | p. 649, right col.-p. 650, left col. | p. 873 |
| 7. Dye image stabilizer | p. 25 | p. 650, left col. | p. 872 |
| 8. Hardening agent | p. 26 | p. 651, left col. | pp. 874–875 |
| 9. Binder | p. 26 | p. 651, left col. | pp. 873–874 |
| 10. Plasticizer, lubricant | p. 27 | p. 650, right col. | p. 876 |
| 11. Coating aid, surface active agent | pp. 26–27 | p. 650, right col. | pp. 875–876 |
| 12. Antistatic agent | p. 27 | p. 650, right col. | pp. 876–877 |
| 13. Matting agent | | | pp. 878–879 |

In the present invention, together with the light-sensitive silver halide, an organic metal salt may be used as an oxidizing agent. Among the organic metal salts, an organic silver salt is particularly preferred.

Examples of the organic compound which can be used in forming the above-described organic silver salt oxidizing agent, include benzotriazoles described in U.S. Pat. No. 4,500,626, columns 52 to 53, aliphatic acids and other compounds. Further, silver acetylide described in U.S. Pat. No. 4,775,613 is useful. The organic silver salts may be used in combination of two or more thereof.

The organic silver salt may be used in an amount of from 0.01 to 10 mol, preferably from 0.01 to 1 mol, per mol of the light-sensitive silver halide. The total coated amount of the light-sensitive silver halide and the organic silver salt is suitably, in terms of silver, from 0.05 to 10 $g/m^2$, preferably from 0.1 to 4 $g/m^2$.

As the binder in the constituent layers of the light-sensitive material, a hydrophilic binder is preferably used. Examples thereof include those described in Research Disclosure and JP-A-64-13546, pages (71) to (75). More specifically, a transparent or translucent hydrophilic binder is preferred and examples thereof include natural compounds such as proteins (e.g., gelatin and gelatin derivative) and polysaccharides (cellulose derivatives, starch, gum arabi, dextran, plurane); and synthetic polymer compounds such as polyvinyl alcohol, polyvinyl pyrrolidone and acrylamide polymer. Further, highly absorptive polymers described in U.S. Pat. No. 4,960,681 and JP-A-62-245260, more specifically, homopolymers of a vinyl monomer having —COOM or —$SO_3M$ (wherein M represents a hydrogen atom or an alkali metal) and copolymers of the vinyl monomers or of the vinyl monomer with other vinyl monomer (e.g., sodium methacrylate, ammonium methacrylate, Sumikagel L-5H produced by Sumitomo Chemical Co., Ltd.) may also be used. These binders may be used in combination of two or more thereof. In particular, a combination of gelatin with the above-described binder is preferred. The gelatin may be selected from lime-processed gelatin, acid-processed gelatin and so-called delimed gelatin reduced in the content of calcium or the like, and these may be preferably used in combination.

In the present invention, the amount of binder coated is preferably 20 $g/m^2$ or less, more preferably 10 $g/m^2$ or less.

The coupler for use in the present invention may be either a 4-equivalent coupler or a 2-equivalent coupler. Further, a non-diffusible group may form a polymer chain. Specific examples of the coupler are described in detail in T. H. James, The Theory of the Photographic Process, 4th Ed. pp. 291–334 and pp. 354–361, JP-A-58-123533, JP-A-58-148046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, and Japanese Patent Application Nos. 6-270700, 6-307049 and 6-312380.

Further, the following couplers are preferably used.

Yellow Coupler:

Couplers represented by formulae (I) and (II) of EP 502424A; couplers represented by formulae (1) and (2) of EP 513496A; couplers represented by formula (I) in claim 1 of Japanese Patent Application No. 4-134523 (corresponding to JP-A-5-307248); couplers represented by formula D in column 1, lines 45 to 55 of U.S. Pat. No. 5,066,576; couplers represented by formula D in paragraph 0008 of JP-A-4-274425; couplers described in claim 1 at page 40 of EP 498381A1; couplers represented by formula (Y) at page 4 of EP 447969A1; couplers represented by formulae (I) to (IV) in column 7, lines 36 to 58 of U.S. Pat. No. 4,476,219.

Magenta Coupler:

Couplers described in JP-A-3-39737, JP-A-6-43611, JP-A-5-204106 and JP-A-4-3626.

Cyan Coupler:

Couplers described in JP-A-204843, JP-A-4-43345 and Japanese Patent Application No. 4-236333.

Polymer Coupler:

Couplers described in JP-A-2-44345.

As the coupler which provides a colored dye having an appropriate diffusibility, those described in U.S. Pat. No. 4,366,237, British Patent 2,125,570, EP 96570 and German Patent 3,234,533 are preferred.

Further, the light-sensitive material of the present invention may contain the following functional couplers. Examples of the coupler for correcting unnecessary absorption of a colored dye include yellow colored cyan couplers described in EP 456257A1, yellow colored magenta couplers described in EP 456257A1, magenta colored cyan couplers described in U.S. Pat. No. 4,833,069, and colorless masking couplers represented by formula (2) of U.S. Pat. No. 4,837,136 and formula (A) claim 1 of WO92/11575 (particularly, compounds described in pages 36 to 45).

Examples of the compound (including coupler) which releases a photographically useful compound upon reaction with an oxidation product of a developing agent include the following compounds.

Development Inhibitor-Releasing Compound:

Compounds represented by formulae (I), (II), (III) and (IV) described at page 11 of EP 78236A1; compounds represented by formula (I) described at page 7 of EP 436938A2; compounds represented by formula (1) of JP-A-5-307248; and compounds represented by formulae (I), (II) and (III) described at pages 5 and 6 of EP 440195A2.

Ligand-Releasing Compound:

Compounds represented by LIG-X described in claim 1 of U.S. Pat. No. 4,555,478.

The light-sensitive material of the present invention must contain a color developing agent of which oxidation product produced by silver development can couple with the above-described coupler to form a dye.

In this case, a combination of a p-phenylenediamine developing agent with a phenol or active methylene coupler described in U.S. Pat. No. 3,531,256, or a combination of a p-aminophenol developing agent with an active methylene coupler described in U.S. Pat. No. 3,761,270 may be used.

The sulfonamidophenol as described in U.S. Pat. No. 4,021,240 and JP-A-60-128438 is preferred because when they are contained in the light-sensitive material, excellent stock storability is provided.

In incorporating a color developing agent, a precursor of the color developing agent may also be used. Examples thereof include indoaniline compounds described in U.S. Pat. No. 3,342,597, Schiff base type compounds described in U.S. Pat. No. 3,342,599, Research Disclosure, No. 14850 and ibid., No. 15159, aldol compounds described in ibid., No. 13924, metal salt complexes described in U.S. Pat. No. 3,719,492, and urethane-base compounds described in JP-A-53-135628.

Also, a combination of a sulfonamidophenol developing agent described in Japanese Patent Application No. 7-180568 or a hydrazine developing agent described in Japanese Patent Application Nos. 7-49287 (corresponding to EP 727708 A) and 7-63572 (corresponding to JP-A-8-234388) with a coupler is preferably used in the light-sensitive material of the present invention.

In the present invention, the compound represented by formula I, II, III or IV is preferably used as the developing agent. Among these, the compounds represented by formulae I and II are preferred.

These developing agents are described in detail below.

The compound represented by formula I is a compound generically called as sulfonamidophenol and known in the art. In the compound when used in the present invention, at least one of the substituents $R_1$ to $R_5$ preferably has a ballast group having 8 or more carbon atoms.

In formula I, $R_1$ to $R_4$ each represents a hydrogen atom, a halogen atom (e.g., chlorine, bromine), an alkyl group (e.g., methyl, ethyl, isopropyl, n-butyl, t-butyl), an aryl group (e.g., phenyl, tolyl, xylyl), an alkylcarbonamido group (e.g., acetylamino, propionylamino, butyroylamino), an arylcarbonamido group (e.g., benzoylamino), an alkylsulfonamido group (e.g., methanesulfonylamino, ethanesulfonylamino), an arylsulfonamido group (e.g., benzenesulfonylamino, toluenesulfonylamino), an alkoxy group (e.g., methoxy, ethoxy, butoxy), an aryloxy group (e.g., phenoxy), an alkylthio group (e.g., methylthio, ethylthio, butylthio), an arylthio group (e.g., phenylthio, tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), an arylcarbamoyl group (e.g., phenylcarbamoyl, methylphenylcarbamoyl, ethylphenylcarbamoyl, benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl, ethanesulfonyl), an arylsulfonyl group (e.g., phenylsulfonyl, 4-chlorophenylsulfonyl, p-toluenesulfonyl), an alkoxycarbonyl group (e.g., methoxycarbonyl, ethoxycarbonyl, butoxycarbonyl), an acryloxycarbonyl group (e.g., phenoxycarbonyl), an alkylcarbonyl group (e.g., acetyl, propionyl, butyroyl), an arylcarbonyl group (e.g., benzoyl, alkylbenzoyl) or an acyloxy group (e.g., acetyloxy, propionyloxy, butyroyloxy). Out of $R_1$ to $R_4$, $R_2$ and $R_4$ each is preferably a hydrogen atom. The sum of the Hammett's constants $\sigma_p$ of $R_1$ to $R_4$ is preferably 0 or more. $R_5$ represents an alkyl group (e.g., methyl, ethyl, butyl, octyl, lauryl, cetyl, stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl, 3,5-di-(methoxycarbonyl)) or a heterocyclic group (e.g., pyridyl).

The compound represented by formula II is a compound generically called as carbamoylhydrazine and known in the art. In the compound when used in the present invention, $R_5$ or a substituent of the ring preferably has a ballast group having 8 or more carbon atoms.

In formula II, Z represents an atomic group necessary for forming an aromatic ring. The aromatic ring formed by Z must be sufficiently electron attractive (withdrawing property) so as to impart silver development activity to the compound. Accordingly, a nitrogen-containing aromatic ring or an aromatic group resulting from introducing an electron attractive (withdrawing) group into the benzene ring is preferably formed. Preferred examples of the aromatic ring include a pyridine ring, a pyrazine ring, a pyrimidine ring, a quinoline ring and a quinoxaline ring. In the case of a benzene ring, examples of the substituent thereof include an alkylsulfonyl group (e.g., methanesulfonyl, ethanesulfonyl), a halogen atom (e.g., chlorine, bromine), an alkylcarbamoyl group (e.g., methylcarbamoyl, dimethylcarbamoyl, ethylcarbamoyl, diethylcarbamoyl, dibutylcarbamoyl, piperidinecarbamoyl, morpholinocarbamoyl), an arylcarbamoyl group (e.g., phenylcarbamoyl, methylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl, ethanesulfonyl), an arylsulfonyl group (e.g., phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbonyl group (e.g., phenoxycarbonyl), an alkylcarbonyl group (e.g., acetyl, propionyl, butyroyl) and an arylcarbonyl group (e.g., benzoyl, alkylbenzoyl). The sum of the Hammett's constant $\sigma$ values of the substituents is preferably 1 or more.

The compound represented by formula III is a compound generically called as carbamoylhydrazine. The compound represented by formula IV is a compound generally called as sulfonylhydrazine. These compounds both are known in the art. In the compounds when used in the present invention, at least one of $R_5$ to $R_8$ preferably has a ballast group having 8 or more carbon atoms.

In formulae III and IV, $R_6$ represents an alkyl group (e.g., methyl, ethyl), X represents an oxygen atom, a sulfur atom, a selenium atom or an alkyl-substituted or aryl-substituted tertiary nitrogen atom, with the alkyl-substituted tertiary nitrogen atom being preferred, $R_7$ and $R_8$ each represents a hydrogen atom or a substituent (examples thereof include those described above as the substituent of the benzene ring formed by Z), and $R_7$ and $R_8$ may be combined with each other to form a double bond or a ring.

Among the compounds represented by formulae I to IV, the compounds represented by formulae I and II are preferred in the present invention in view of stock storability.

The groups represented by $R_1$ to $R_8$ each may have a substituent, if possible, and examples of the substituent include those described above as the substituent of the benzene ring formed by Z.

Specific examples of the compounds represented by formulae I to IV are set forth below, however, the compounds of the present invention are by no means limited thereto.

D-1

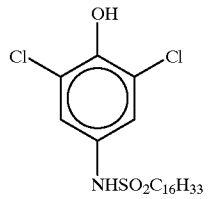

D-2

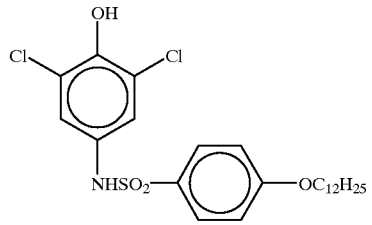

D-3

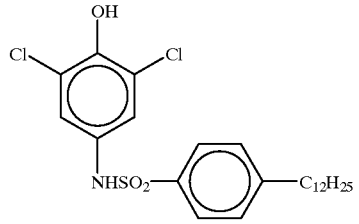

D-4

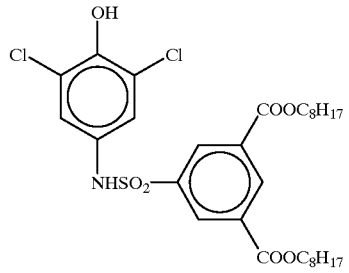

-continued
D-5
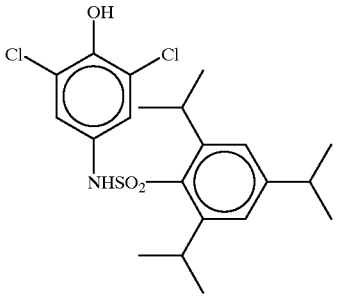
D-6
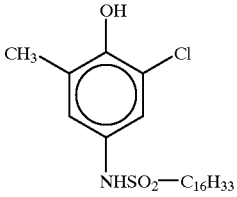
D-7
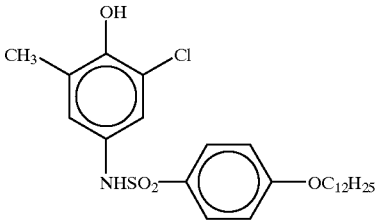
D-8
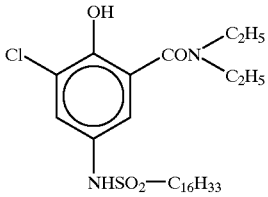
D-9
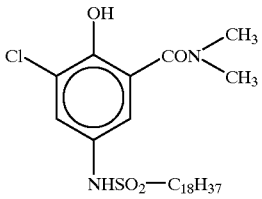
D-10
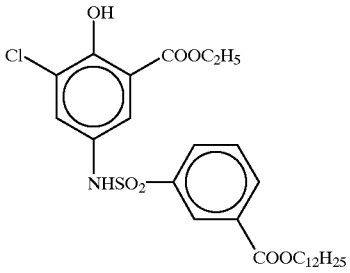
-continued
D-11
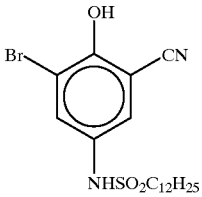
D-12
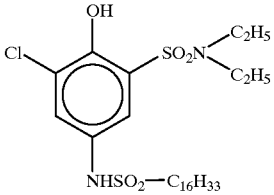
D-13
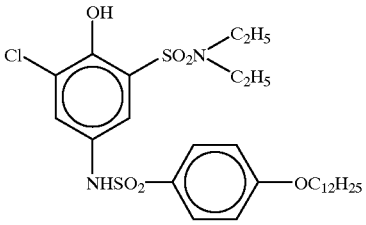
D-14
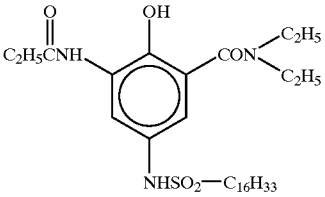
D-15
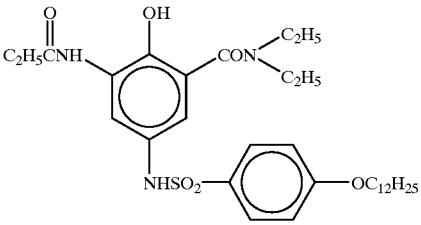
D-16
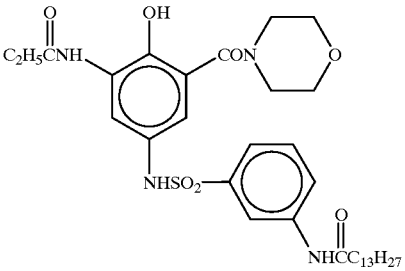

-continued
D-17
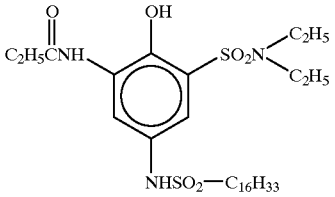
D-18
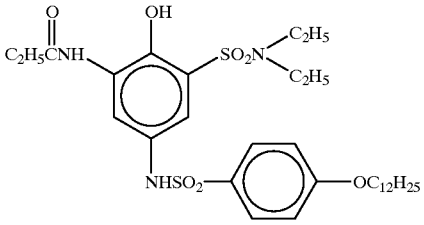
D-19
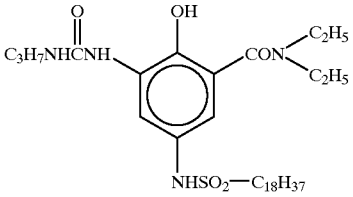
D-20
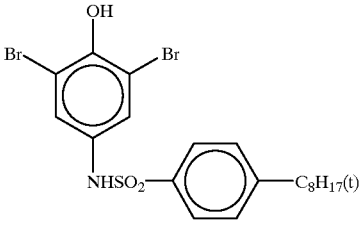
D-21
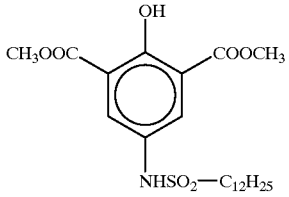
D-22
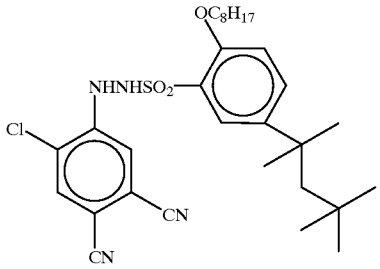
-continued
D-23
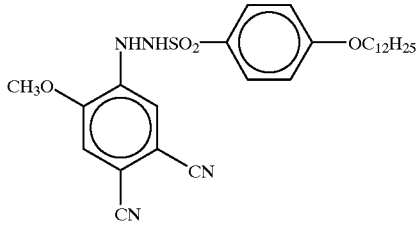
D-24
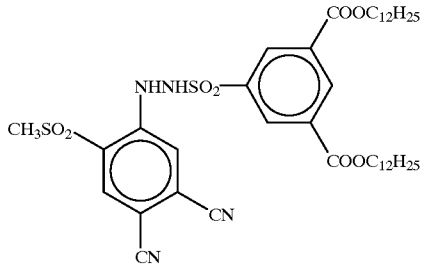
D-25
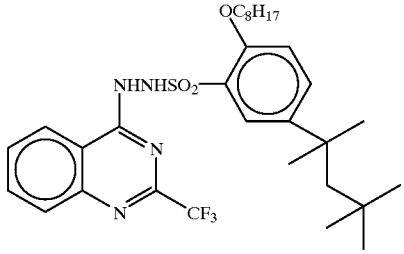
D-26
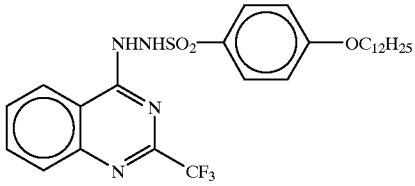
D-27
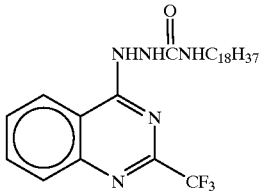
D-28
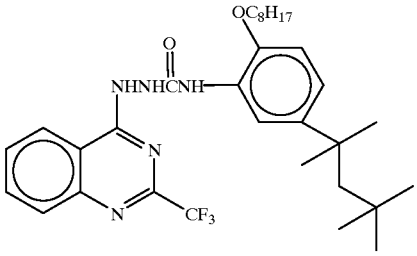

-continued
D-29
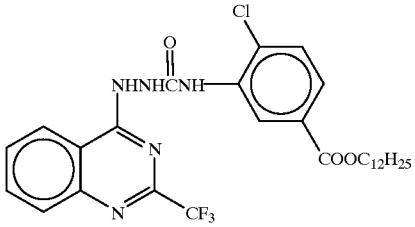
D-30
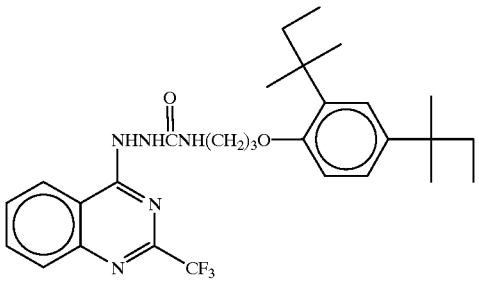
D-31
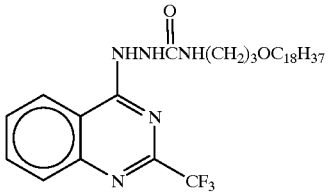
D-32
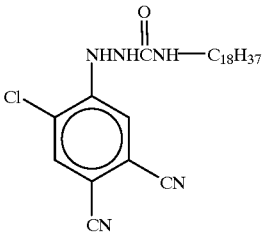
D-33
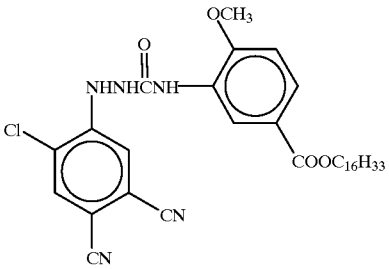
-continued
D-34
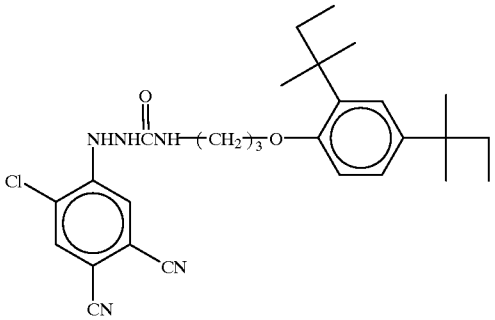
D-35
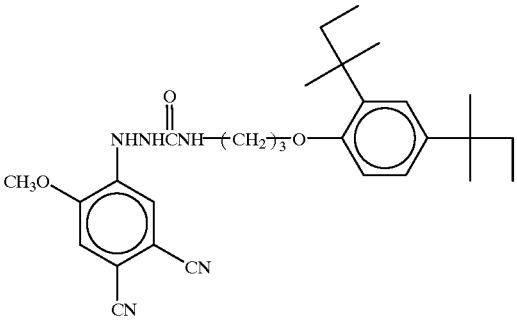
D-36
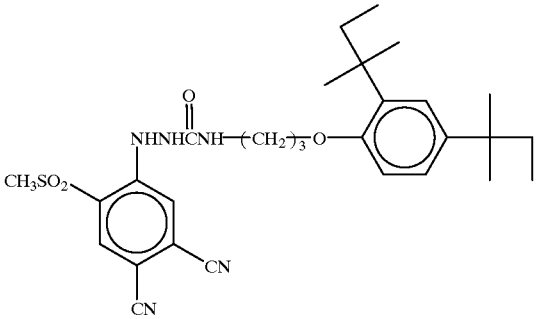
D-37
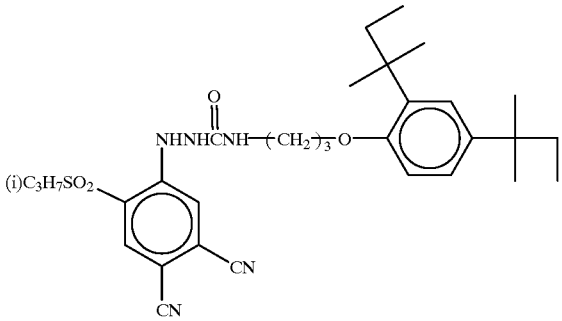

-continued
D-38
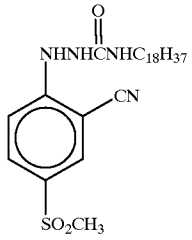
D-39
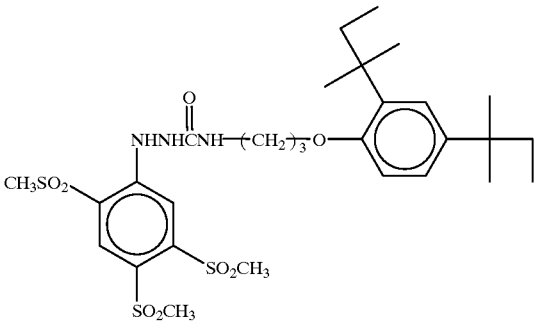
D-40
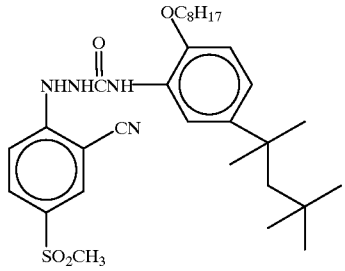
D-41
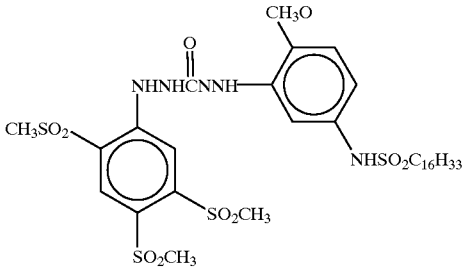
D-42
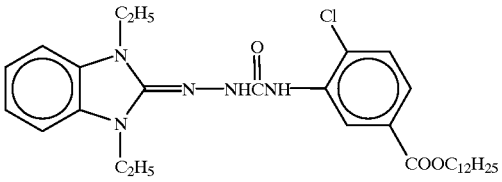
D-43
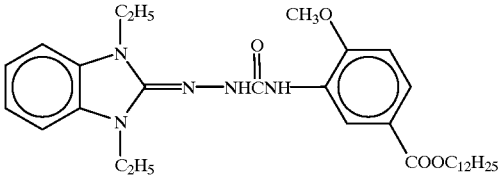
-continued
D-44
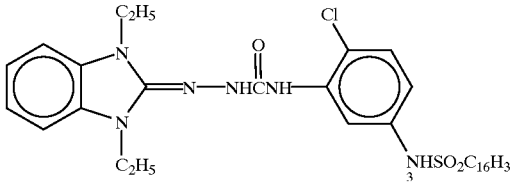
D-45
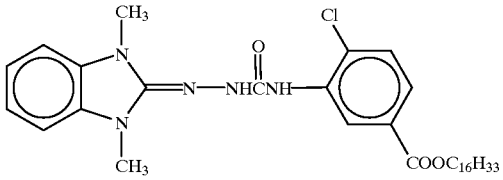
D-46
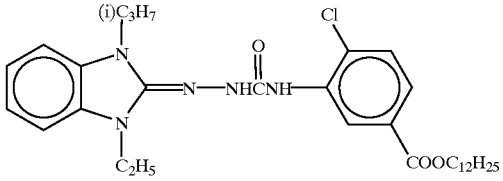
D-47
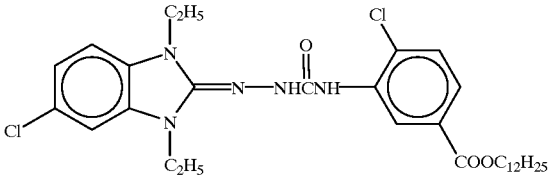
D-48
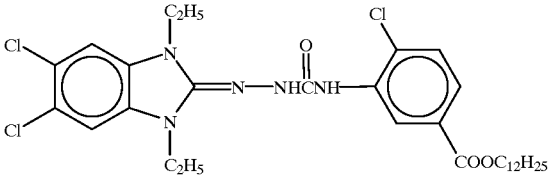
D-49
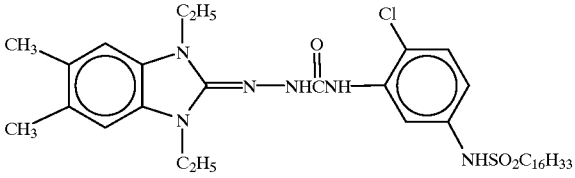
D-50
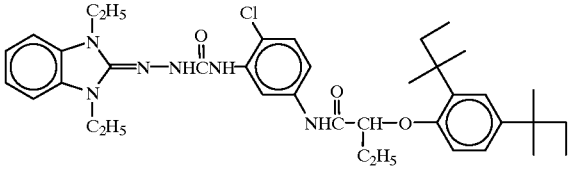

-continued
D-51
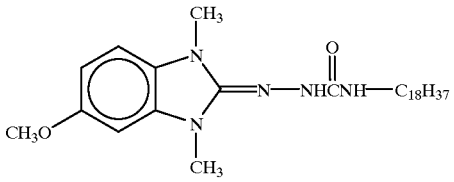
D-52
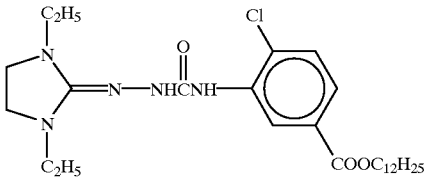
D-53
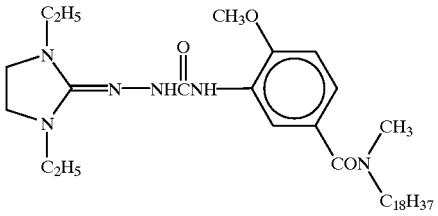
D-54
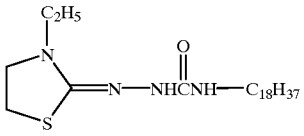
D-55
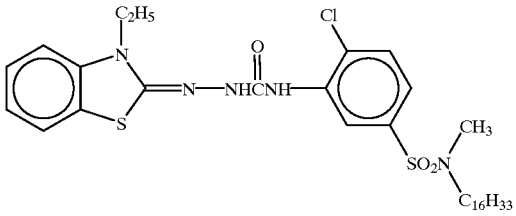
D-56
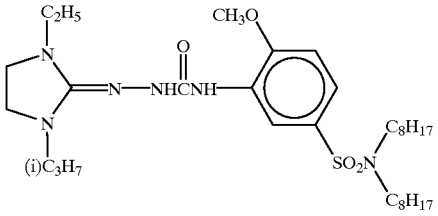
The above-described compounds can be synthesized by a generally known method. Examples of simple synthesis routes are described below.
Synthesis of Developing Agent D-2:
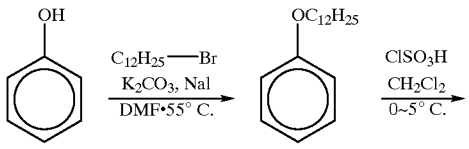
-continued
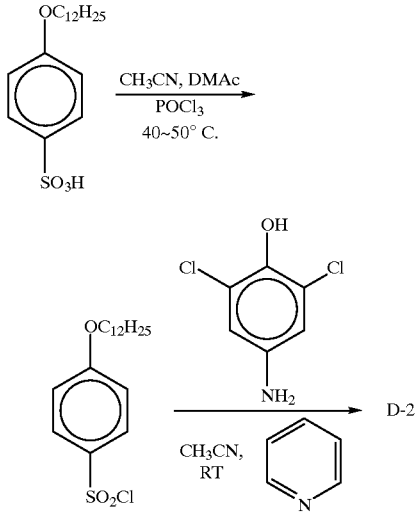
Synthesis of Developing Agent D-27:
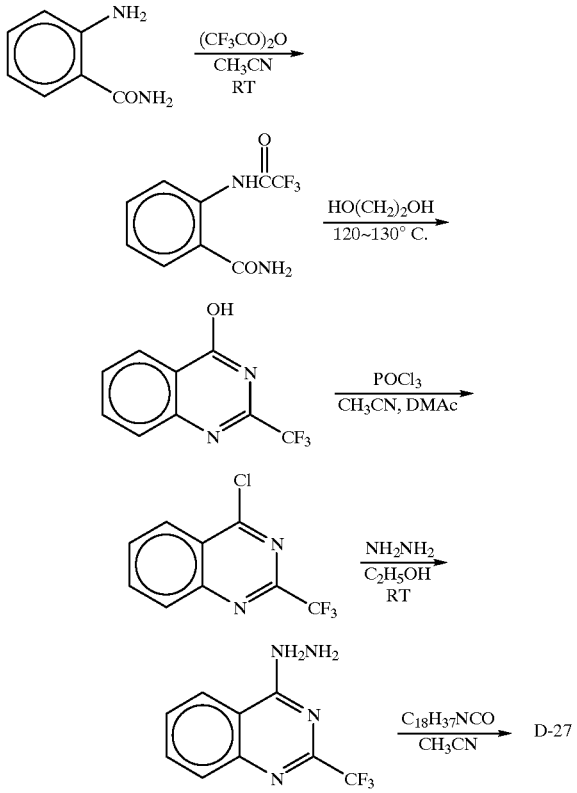
Synthesis of D-42:
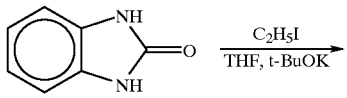

-continued

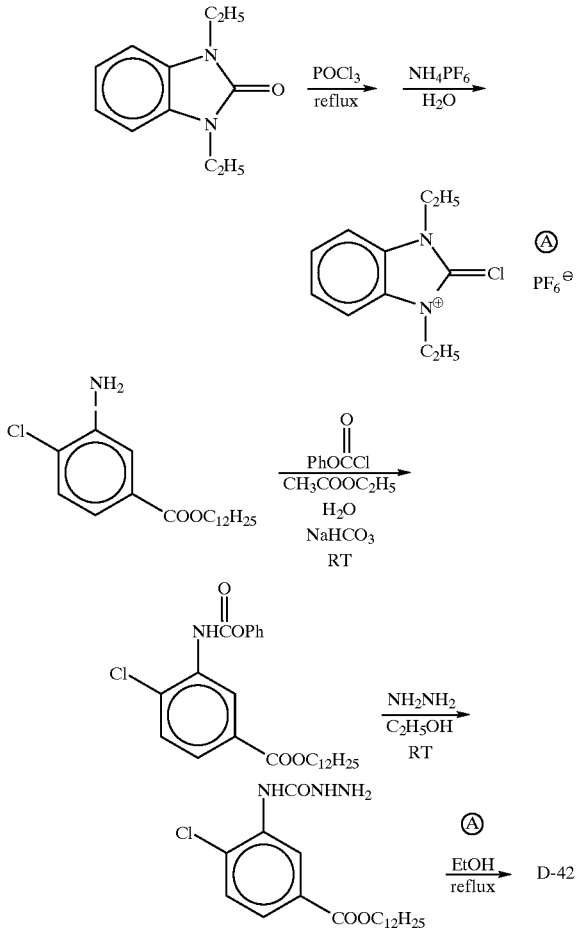

In the case when a non-diffusible developing agent is used, an electron transferring agent and/or an electron transferring agent precursor may be used in combination, if desired, so as to accelerate transfer of electrons between the non-diffusible developing agent and developable silver halide. In particular, those described in U.S. Pat. No. 5,139,919 and European Unexamined Patent Publication 418743 are preferred. Further, a method of stably introducing it into a layer as described in JP-A-2-230143 and JP-A-2-235044 is preferably used.

The electron transferring agent or a precursor thereof may be selected from the above-described developing agents and precursors thereof. The electron transferring agent or a precursor thereof preferably has mobility larger than that of the non-diffusible developing agent (electron donor). Particularly useful electron transferring agents are 1-phenyl-3-pyrazolidones and aminophenols.

The electron donor precursors described in JP-A-3-160443 are also preferably used.

The interlayer or the protective layer may use a reducing agent for various purposes such as prevention of color mixing or improvement of color reproduction. Specific preferred examples thereof include reducing agents described in European Unexamined Patent Publications 524649 and 357040, JP-A-4-249245, JP-A-2-46450 and JP-A-63-186240. The development inhibitor-releasing reducing agent compounds described in JP-B-3-63733, JP-A-1-150135, JP-A-2-46450, JP-A-2-64634, JP-A-3-43735 and European Unexamined Patent Publication 451833 may also be used.

A developing agent precursor which itself has no reducing property but exerts reducing property by the action of a nucleophilic reagent or heat, may be used.

In addition, a reducing agent as described below may also be incorporated into the light-sensitive material.

Examples of the reducing agent for use in the present invention include reducing agents and reducing agent precursors described in U.S. Pat. Nos. 4,500,626 (columns 49 and 50), 4,839,272, 4,330,617, 4,590,152, 5,017,454 and 5,139,919, JP-A-60-140335 (pages (17) and (18)), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546 (pates (40) to (57)), JP-A-1-120553 and European Unexamined Patent Publication 220746A2 (pages 78 to 96).

Further, various reducing agents may be used in combination as disclosed in U.S. Pat. No. 3,039,869.

The developing agent or the reducing agent may be incorporated into the processing sheet which will be described layer, or may be incorporated into the light-sensitive material.

In the present invention, the total addition amount of the developing agent and the reducing agent is from 0.1 to 20 mol, preferably from 0.1 to 10 mol per mol of silver.

As the coupler for use in the present invention, a 4-equivalent coupler or a 2-equivalent coupler may be properly choosed depending upon the kind of the developing agent. By choosing the above-described combination, color turbidity ascribable to the transfer of an oxidation product of the developing agent between layers can be prevented. Specific examples of the coupler, both the 4-equivalent coupler and the 2-equivalent coupler, are described in detail in T. H. James (compiler), Theory of the Photographic Process, 4th ed., pages 291 to 334 and pages 354 to 361, Macmillan (1977), JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474, JP-A-60-66249 and patents and publications cited therein.

The hydrophobic additive such as coupler, developing agent and non-diffusible reducing agent can be introduced into a layer of the light-sensitive material by a known method such as the method described in U.S. Pat. No. 2,322,027. In this case, a high boiling point as described in U.S. Pat. Nos. 4,555,470, 4,536,466, 4,536,467, 4,587,206, 4,555,476 and 4,599,296 and JP-B-3-62256 may be used, if desired, in combination with a low boiling point organic solvent having a boiling point of from 50 to 160° C. The dye donating compounds, the non-diffusible reducing agents or the high-boiling point organic solvents may be used in combination of two or more thereof.

The amount of the high boiling point organic solvent is 10 g or less, preferably 5 g or less, more preferably from 0.1 to 1 g, per g of the hydrophobic additive used. Further, it is suitably 1 ml or less, preferably 0.5 ml or less, more preferably 0.3 ml or less, per g of the binder.

The dispersion method using a polymer described in JP-B-51-39853 and JP-A-51-59943 or the method of forming a fine particle dispersion and adding it described in JP-A-62-30242 may also be used.

In the case of a compound substantially insoluble in water, other than the above-described methods, the compound may be dispersed and contained in the binder after forming it into fine particle.

In dispersing a hydrophobic compound in hydrophilic colloid, various surface active agents may be used.

Examples thereof include those described as the surface active agent in JP-A-59-157636, pages (37) and (38), and the above-described Research Disclosure. Further, phosphoric ester type surface active agents described in Japanese Patent Application Nos. 5-204325 (JP-A-5-204325) and 6-19247 (JP-A-228589) and West German Patent Publication (OLS) No. 1,932,299A may also be used.

In the present invention, the light-sensitive material may contain a compound capable of achieving activation of development and at the same time, stabilization of the image. Specific preferred examples of the compound include those described in U.S. Pat. No. 4,500,626, columns 51 and 52.

The light-sensitive material may have various light-insensitive layers such as a protective layer, an undercoat layer, an interlayer, a yellow filter layer and an antihalation layer, between the above-described silver halide emulsion layers or as the uppermost layer or the lowermost layer. On the opposite side of the support, various auxiliary layers such as a back layer may be provided. More specifically, the layer structure as described in U.S. Pat. No. 4,500,626 may be used, or an undercoat layer as described in U.S. Pat. No. 5,051,335, an interlayer having a solid pigment as described in JP-A-1-167838 and JP-A-61-20943, an interlayer having a reducing agent or a DIR compound as described in JP-A-1-120553, JP-A-5-34884 and JP-A-2-64634, an interlayer having an electron transferring agent as described in U.S. Pat. Nos. 5,017,454 and 5,139,919 and JP-A-2-235044, a protective layer having a reducing agent as described in JP-A-4-249245 or a layer comprising a combination of these layers, may be provided.

The dyestuff which can be used in the yellow filter layer or the antihalation layer is preferably a dyestuff capable of decoloring or dissolving out at the time of development and having no contribution to the density after processing.

The term "a dyestuff in the yellow filter layer or the antihalation layer decolors or is removed at the time of development" means that the amount of the dyestuff remaining after processing is reduced to ⅓ or less, preferably 1/10 or less of the amount immediately before coating. The dyestuff component may dissolve out from the light-sensitive material or transfer into the processing material during development or may react upon development to turn into a colorless compound.

The dyestuff which can be used in the light-sensitive material of the present invention may be a known dyestuff. Examples thereof include a dyestuff which dissolves in alkali of the developer and a dyestuff which reacts with the component in the developer, with the sulfite ion or developing agent, or with the alkali to decolor.

Specific examples thereof include dyestuffs described in EP 549489A and Dyestuffs ExF2 to ExF6 described in JP-A-7-152129. A solid disperse dyestuff as described in Japanese Patent Application No. 6-259805 (JP-A-8-101487) may also be used. This dyestuff may be used in the case where the light-sensitive material is developed with a processing solution, however, it is preferably used in the case where the light-sensitive material is heat developed using a processing sheet which will be described later.

The dyestuff may be mordanted to a mordanting agent and a binder. In this case, the mordanting agent and the dyestuff each may be one known in the photographic field, and examples of the mordanting agent include mordanting agents described in U.S. Pat. No. 4,500,626 (columns 5-8 and 59), JP-A-61-88256 (pages 32 to 41), JP-A-62-244043 and JP-A-62-244036.

Further, a compound which releases a diffusible dye upon reaction with a reducing agent may be used together with a reducing agent, whereby a movable dye is released in alkali during development and removed by dissolving out into a processing solution or transferring to the processing sheet. Specific examples of the compound include those described in U.S. Pat. Nos. 4,559,290 and 4,783,369, EP 220746A2, JIII Journal of Technical Disclosure No. 87-6119 and Japanese Patent Application No. 6-259805 (paragraph Nos. 0080 and 0081; corresponding to JP-A-8-101487).

A leuco dye which decolors may also be used and JP-A-1-150132 specifically discloses a silver halide light-sensitive material containing a leuco dye previously colored by an organic acid metal salt developer. The leuco dye and the developer complex decolor upon heating or reaction with an alkali agent and accordingly, in the case where the light-sensitive material is heat developed in the present invention, the combination of a leuco dye and a developer is preferred.

The leuco dye used may be a known one and it is described in Moriga and Yoshida, Senryo to Yakuhin (Dyestuff and Chemicals), 9, page 84, Kaseihin Kogyo Kyokai, Shin-pan Senryo Binran (New Version of Dyestuff Handbook), page 242, Maruzen (1970), R. Garner, Reports on the Process of Appl. Chem., 56, page 199 (1971), Senryo to Yakuhin (Dyestuff and Chemicals), 19, page 230, Kaseihin Kogyo Kyokai (1974), Shikizai (Coloring Material), 62, page 288 (1989), and Senryo Kogyo (Dyestuff Engineering), 32, 208.

The developer is preferably an acid clay-base developer, a phenolformaldehyde resin or an organic acid metal salt. The organic acid metal salt is preferably a metal salt of salicylic acids, a metal salt of phenol-salicylic acid-formaldehyde resin, a rhodanate or a metal salt of xanthate, and the metal is preferably zinc. Out of the above-described developer, with respect to the oil-soluble zinc salicylate, those described in U.S. Pat. Nos. 3,864,146 and 4,046,941 and JP-B-52-1327 may be used.

The light-sensitive material of the present invention is preferably hardened by a hardening agent.

Examples of the hardening agent include hardening agents described in U.S. Pat. Nos. 4,678,739 (column 41) and 4,791,042, JP-A-59-116655, JP-A-62-245261, JP-A-61-18942 and JP-A-4-218044. Specific examples thereof include an aldehyde-base hardening agent (e.g., aldehyde), an aziridine-base hardening agent, an epoxy-base hardening agent, a vinylsulfone-base hardening agent (e.g., N,N'-ethylenebis(vinylsulfonyl-acetamido)ethane), an N-methylol-base hardening agent (e.g., dimethylolurea), a boric acid, a metaboric acid and a high molecular hardening agent (e.g., compounds described in JP-A-62-234157, etc.).

The hardening agent is used in an amount of from 0.001 to 1 g, preferably from 0.005 to 0.5 g, per g of the hydrophilic binder.

The light-sensitive material may contain an anti-foggant, a photographic stabilizer or a precursor thereof. Specific examples thereof include the compounds described in the above-described Research Disclosure, U.S. Pat. Nos. 5,089,378, 4,500,627 and 4,614,702, JP-A-64-13564 (pages (7) to (9), pages (57) to (71) and pages (81) to (97)), U.S. Pat. Nos. 4,775,610, 4,626,500 and 4,983,494, JP-A-62-174747, JP-A-62-239148, JP-A-1-150135, JP-A-2-110557, JP-A-2-178650 and RD No. 17643 (1978), pages (24) to (25).

The compound is preferably used in an amount of from $5\times10^{-6}$ to $1\times10^{-1}$ mol, more preferably from $1\times10^{-5}$ to $1\times10^{-2}$ mol, per mol of silver.

The light-sensitive material of the present invention is, after exposure, developed by supplying water corresponding to from 1/10 to 1 times the water necessary for giving maximum swelling of all coated layers constituting the light-sensitive material and the processing material, laminating the light-sensitive material on the processing material containing a base and/or a base precursor, and heating the materials.

The present invention has an object of achieving good graininess and wide exposure latitude in the above-described heat development and is intended to lighten the load on environment to be imposed in liquid development. However, the light-sensitive material of the present invention may be developed by an activator method using an alkali processing solution or with a processing solution containing a developing agent and a base to form an image.

Heat treatment of a light-sensitive material is known in this technical field, and the heat-developable light-sensitive material and the process therefor are described, for example, in Shashin Kogaku no Kiso (Primary Study of Photographic Industry), pages 553 to 555, Corona Sha (1970), Eizo Joho (Image Information), page 40 (April 1978), Nabletts Handbook of Photography and Reprography, 7th ed., pages 32 to 33, Vna Nostrand and Reinhold Company, U.S. Pat. Nos. 3,152,904, 3,301,678, 3,392,020 and 3,457,075, British Patents 1,131,108 and 1,167,777, and Research Disclosure (RD-17029), pages 9 to 15 (June 1978).

The activator processing is a processing method of developing a light-sensitive material self-containing a color developing agent with a processing solution containing no color developing agent. In this case, the processing solution is characterized by containing no color developing agent which is contained in usual development processing solution components, and may contain other components (for example, alkali or auxiliary developing agent). Examples of the activator processing are described in known publications such as EP 545491A1 and EP 565165A1.

The method of developing a light-sensitive material with a processing solution containing a developing agent and a base is described in RD No. 17643, pages 28 and 29, ibid. No. 18716, page 651, left to right columns, and ibid., No. 307105, pages 880 and 881.

The processing raw materials and the processing method for use in the present invention in the case of heat development processing are described in detail below.

In the light-sensitive material of the present invention, a base or a base precursor is preferably used for the purpose of accelerating silver development and dye formation reaction. Examples of the base precursor include a salt of a base with an organic acid capable of decarboxylation by heat and a compound which releases an amine by intramolecular nucleophilic substitution reaction, Rossen rearrangement or Beckmann rearrangement. Specific examples thereof are described in U.S. Pat. Nos. 4,514,493 and 4,657,848 and Kochi Gijutu (Known Techniques), No. 5, Aztec Limited (Mar. 22, 1991). Also, a method of generating a base by the combination of a sparingly water-soluble basic metal compound with a compound capable of complex formation reaction with the metal ion constituting the basic metal compound using water as a medium, may also be used. The amount of the base or the base precursor used is from 0.1 to 20 g/m$^2$, preferably from 1 to 10 g/m$^2$.

The light-sensitive material of the present invention may contain a heat solvent for the purpose of accelerating heat development. Examples thereof include organic compounds having polarity as described in U.S. Pat. Nos. 3,347,675 and 3,667,959. Specific examples thereof include amide derivatives (e.g., benzamide), urea derivatives (e.g., methylurea, ethyleneurea), sulfonamide derivatives (e.g., compounds described in JP-B-1-40974 and JP-B-4-13701), polyol compounds, sorbitols and polyethylene glycols.

When the heat solvent is water insoluble, it is preferably used as a solid dispersion. The layer to which the heat solvent is added may be either a light-sensitive layer or a light-insensitive layer depending on the purpose.

The addition amount of the heat solvent is from 10 to 500 wt %, preferably from 20 to 300 wt %, of the binder in the layer to which the heat solvent is added.

The heating temperature in the heat development process is from about 50 to 250° C., preferably from 60 to 100° C.

In order to feed the base necessary in the heat development process, a processing material having a processing layer containing a base or a base precursor is used. The processing material may have additional functions of shielding air at the heat development, preventing volatilization of raw materials from the light-sensitive material, feeding materials for the processing other than the base to the light-sensitive material, or removing materials (e.g., YF dyestuff, AH dyestuff) in the light-sensitive material which become unnecessary after the development or unnecessary components generated during the development. The support and the binder of the processing material may be the same as those used in the light-sensitive material.

The processing material may contain a mordanting agent for the purpose of removing the dyestuff as described above. The mordanting agent used may be a mordanting agent known in the photographic field and examples thereof include the mordanting agents described in U.S. Pat. No. 4,500,626, columns 58 and 59, JP-A-61-88256, pages 32 to 41, JP-A-62-244043 and JP-A-62-244036. A dye acceptable high molecular compound described in U.S. Pat. No. 4,463,079 may also be used. Further, the processing material may contain the above-described heat solvent.

The processing material contains a base or a base precursor in the processing layer. The base may be either an organic base or an inorganic base. Examples of the base precursor which can be used include those described above. The amount of the base or the base precursor used is from 0.1 to 20 g/m$^2$, preferably from 1 to 10 g/m$^2$.

In performing heat development using a processing material, a slight amount of water is used for the purpose of accelerating development, accelerating transfer of the material for processing or accelerating diffusion of unnecessary matters. This is specifically described in U.S. Pat. Nos. 4,704,245 and 4,470,445, and JP-A-61-238056. The water may contain an inorganic alkali metal salt, an organic base, a low boiling point solvent, a surface active agent, an antifoggant, a complex forming compound with a sparingly soluble metal salt, a fungicide or a bactericide.

The water may be any water commonly used. More specifically, distilled water, tap water, well water or mineral water may be used. In the heat development apparatus using the light-sensitive material and the processing material of the present invention, the water may be used up or may be circulated and repeatedly used. In the latter case, water used contains components dissolved out from the light-sensitive material. Apparatuses and water described in JP-A-63-144354, JP-A-63-144355, JP-A-62-38460 and JP-A-3-210555 may also be used.

The water may be fed to the light-sensitive material, the processing material or both of them. The water is used in an amount corresponding to from 1/10 to 1 times the amount necessary for giving maximum swelling of all coated layers (excluding the back layer) of the light-sensitive material and the processing material.

The timing for providing water may be anytime after exposing the light-sensitive material and before the heat-development, preferably just before the heat-development.

The above water amount defined in the present invention defines the water amount necessiated at the heat-development after attaching the light-sensitive material to the processing material. Accordingly, for example, after supplying water more than the water amount defined above to the light-sensitive material or the processing material, an excess amount of water may be removed by e.g., squeegeeing until the light-sensitive material and the processing material are attached to each other, and then the heat development may be conducted. This method may be also within the scope of the present invention.

Normally, the light-sensitive material and the processing material are attached to each other after supplying the necessiated water to one of the light-sensitive material and the processing material or both of them, or after controlling the necessiated water with the means described above, and then the heat development is conducted; however, after attaching the light-sensitive material to the processing material, water may be supplied to the gap between the light-sensitive material and the processing material, whereby the necessiated water exists.

A variety of methods for providing water content may be used in the present invention. An example of the method for providing water includes a method comprising immersing the light-sensitive material or the processing material to water and removing an excess amount of water with a squeegee roller. In this case, the constant amount of water is preferably provided to the light-sensitive material or the processing material in the disposable form. A particularly preferred method for jetting water is a method using a water coat apparatus similar to an ink-jet type recording head comprising a nozzle wherein a plurality of nozzle holes for jetting water are arranged in a straight line or in a plurality of lines at definite intervals along a direction to intersect a conveying direction of the light-sensitive material or the processing material, and an actuator for displacing said nozzle toward the light-sensitive material or the processing material on the conveying path. A method for coating water with e.g., sponge is preferably used because of the simplicity of apparatus.

In feeding the water, the methods described, for example, in JP-A-62-253159, page (5), and JP-A-63-85544 are preferably used. Also, a solvent may be enclosed in a microcapsule or previously incorporated in the form of a hydrate into the light-sensitive material, the processing material or both of them.

The temperature of water fed may be from 30 to 60° C. as described in JP-A-63-85544.

In performing heat development in the presence of a slight amount of water, a method of using as a base precursor a combination of a sparingly water-soluble basic metal compound with a compound capable of complex formation reaction with the metal ion constituting the basic metal compound using water as a medium, and generating a base therefrom is effective as described in European Unexamined Patent Publication 210660 and U.S. Pat. No. 4,740,445. In this case, in view of stock storability, the sparingly water-soluble basic metal compound is preferably added to the light-sensitive material and the complex forming compound is preferably added to the processing material.

The heating method in the development process includes a method of contacting with a heated block or plate, a method of contacting with a hot plate, a hot presser, a heat roller, a heat drum, a halogen lamp heater or an infrared or far infrared lamp heater, and a method of passing through a high temperature atmosphere.

For laminating (attaching) the light-sensitive material and the processing material so that the light-sensitive layer and the processing layer face to each other, the methods described in JP-A-62-253159 and JP-A-61-147244, page (27) may be used. The heating time is preferably from 3 to 100 seconds, most preferably from 5 to 60 seconds.

In processing the photographic elements of the present invention, any of various heat development apparatuses may be used. For example, apparatuses described in JP-A-59-75247, JP-A-59-177547, JP-A-59-181353, JP-A-60-18951, JP-U-A-62-25944 (the term "JP-U-A" as used herein means an "unexamined published Japanese utility model application"), Japanese Patent Application Nos. 4-277517 (JP-A-6-130509), 4-243072 (JP-A-6-95338), 4-244693 (JP-A-6-95267), 6-164421 (JP-A-8-29955) and 6-164422 (JP-A-8-29954) are preferably used.

Examples of commercially available apparatuses which can be used in the present invention include Pictrostat 100, Pictrostat 200, Pictrostat 300, Pictrostat 330, Pictrostat 50, Pictrography 3000 and Pictrography 2000, all manufactured by Fuji Photo Film Co., Ltd.

The light-sensitive material or the processing sheet of the present invention may be in the form having an electrically conductive heating element layer as a heating means for heat development. As the heating element, those described in JP-A-61-145544 may be used.

In the present invention, image information may be taken in without removing developed silver generated by the development or undeveloped silver halide, however, an image may be taken in after removing them. In the latter case, a means for removing them simultaneously with or after the development may be used.

In order to remove developed silver in the light-sensitive material simultaneously with development, to convert silver halide into a complex or to solubilize silver halide, the processing material may contain an oxidizing agent for silver or a rehalogenating agent, which acts as a bleaching agent, or a silver halide solvent which acts as a fixing agent, so that it can cause reaction on heat development.

Further, a second material containing an oxidizing agent for silver, a rehalogenating agent or a silver halide solvent may be laminated on the light-sensitive material after completion of development in the image formation, to remove developed silver, to convert silver halide into a complex or to solubilize silver halide.

In the present invention, the above-described treatment is preferably applied to such a degree that no obstacle arises to the reading of image information after photographing and development in the subsequent image formation. In particular, undeveloped silver halide generates high haze in the gelatin layer to increase the background density of an image and therefore, the above-described complex forming agent is preferably used to reduce haze or solubilize and then remove wholly or partly the undeveloped silver halide from the layer. Further, in order to reduce haze of the silver halide itself, tabular grains having a high aspect ratio or having a high silver chloride content may also be preferably used.

The bleaching agent which can be used in the processing material of the present invention may be any silver bleaching agent commonly used. Such a bleaching agent is described in U.S. Pat. Nos. 1,315,464 and 1,946,640, and Photographic Chemistry, Vol. 2, Chapter 30, Foundation Press, London, England. The bleaching agent effectively oxidizes and then solubilizes the photographic silver image. Useful examples of the silver bleaching agent include an alkali metal bichromate and an alkali metal ferricyanide.

The bleaching agent is preferably soluble in water and examples thereof include ninhydrine, indanedione, hexaketocyclohexane, 2,4-dinitrobenzoic acid, benzoquinone, benzenesulfonic acid and 2,5-dinirobenzoic acid. A metal organic complex such as a ferric salt of cyclohexyldialkylaminotetraacetic acid, a ferric salt of ethylenediaminetetraacetic acid and a ferric salt of citric acid may also be used. As the fixing agent, the above-described silver halide solvent which can be incorporated into the processing material (first processing material) for developing the light-sensitive material, may be used. The binder, the support and other additives which can be used in the second processing material may be the same as used in the first processing material.

The amount of the bleaching agent coated should be varied depending on the amount of silver contained in the light-sensitive material to be laminated, however, it is, based on the coated silver amount per unit area of the light-sensitive material, from 0.01 to 10 mol/mol-coated silver of light-sensitive material, preferably from 0.1 to 3 mol/mol-coated silver of light-sensitive material, more preferably from 0.1 to 2 mol/mol-coated silver of light-sensitive material.

The silver halide solvent used may be a known silver halide solvent. Examples thereof include thiosulfate such as sodium thiosulfate and ammonium thiosulfate, sulfites such as sodium sulfite and sodium hydrogensulfite, thiocyanates such as potassium thiocyanate and ammonium thiocyanate, thioether compounds such as 1,8-di-3,6-dithiaoctane, 2,2'-thiodiethanol and 6,9-dioxa-3,12-dithiatetradecan-1,14-diol described in JP-B-47-11386, compounds having a 5- or 6-membered ring such as uracil and hydantoin described in Japanese Patent Application No. 6-325350, and the compound represented by the following formula (I) described in JP-A-53-144319. Mesoionthiolate compounds such as trimethyltriazolium thiolate described in Analytica Chemica Acta, Vol. 248, pages 604 to 614 (1991) are also preferred. The compound capable of fixing and stabilizing silver halide described in Japanese Patent Application No. 6-206331 (JP-A-8-69097) can also be used as the silver halide solvent.

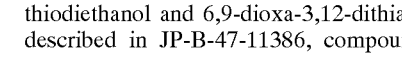

$$N(R^1)(R^2)—C(=S)—X—R^3 \quad (I)$$

wherein X represents a sulfur atom or an oxygen atom, $R^1$ and $R^2$, which may be the same or different, each represents an aliphatic group, an aryl group, a heterocyclic residue or an amino group, $R^3$ represents an aliphatic group or an aryl group, and $R^1$ and $R^2$ or $R^2$ and $R^3$ may be combined to each other to form a 5- or 6-membered heterocyclic ring. The above-described silver halide solvent may be used in combination.

Among the compounds described above, sulfites and compounds having a 6-membered imide ring such as uracil and hydantoin are preferred. In particular, uracil or hydantoin is preferably added in the form of a potassium salt because reduction in the gloss during storage of the processing material can be improved.

The amount of all silver halide solvents contained in the processing layer is from 0.01 to 100 mmol/$m^2$, preferably from 0.1 to 50 mmol/$m^2$, more preferably from 10 to 50 mmol/$m^2$, and in terms of molar ratio to the coated silver amount of the light-sensitive material, from 1/20 to 20 times, preferably from 1/10 to 10 times, more preferably from 1/3 to 3 times. The silver halide solvent may be added to a solvent such as water, methanol, ethanol, acetone, dimethylformamide or methylpropyl glycol or an alkaline or acidic aqueous solution. Or, it may be formed into a solid fine particle dispersion and added to the coating solution.

Further, physical development nuclei and a silver halide solvent may be contained in the processing material so that the silver halide in the light-sensitive material can be solubilized at the same time with development and fixed to the processing layer.

The physical development nuclei are to reduce a soluble silver salt diffused out from the light-sensitive material to convert into a physical developed silver and fix it to the processing layer. As the physical development nuclei, any known physical development nuclei may be used and examples thereof include a heavy metal such as zinc, mercury, lead, cadmium, iron, chromium, nickel, tin, cobalt, copper and ruthenium, a noble metal such as palladium, platinum, silver and gold, and colloid particles thereof of a chalcogen compound such as sulfuric acid, selenium or tellurium. The physical development nuclei substance can be obtained by reducing a corresponding metal ion with a reducing agent such as ascorbic acid, sodium boron hydride or hydroquinone to form a metal colloid dispersion or by mixing a corresponding metal ion with a soluble sulfide, selenide or telluride solution to form a colloid dispersion of water-insoluble metal sulfide, metal selenide or metal telluride. The dispersion is preferably formed in a hydrophilic binder such as gelatin. The preparation method of colloidal silver particles is described in U.S. Pat. No. 2,688,601. If desired, desalting known to the preparation method of a silver halide emulsion may be performed for removing excessive salts.

The physical development nuclei preferably have a particle size of from 2 to 200 nm.

The physical development nuclei are contained in the processing layer in an amount of usually from $10^{-3}$ to 100 mg/$m^2$, preferably from $10^{-2}$ to 10 mg/$m^2$.

The physical development nuclei may be separately prepared and added to the coating solution, however, it may also be formed by reacting, for example, silver nitrate with sodium sulfide, or gold chloride with a reducing agent or the like, in a coating solution containing a hydrophilic binder.

The physical development nuclei are preferably silver, silver sulfide or palladium. In the case where the physical developed silver transferred to the complex forming agent sheet is used as an image, palladium sulfide and silver sulfide are preferred because Dmin is reduced and Dmax is high.

The first processing material and the second processing material each may have at least one polymerizable timing layer. The timing layer can temporarily delay the bleaching/fixing reaction until reaction of the desired silver halide with a dye donative compound or a developing agent substantially completes. The timing layer may comprise gelatin, polyvinyl alcohol or polyvinyl alcohol-polyvinyl acetate. This layer may also be a barrier timing layer as described, for example, in U.S. Pat. Nos. 4,056,394, 4,061,496 and 4,229,516.

In the case of coating the timing layer, it is coated to have a thickness of from 5 to 50 $\mu$m, preferably from 10 to 30 $\mu$m.

In the present invention, for bleaching/fixing a developed light-sensitive material using the second processing material, water in an amount corresponding to from 0.1 to 1 times the amount necessary for achieving maximum swelling of all coated layers excluding the back layer, of both the light-sensitive material and the second processing material is supplied to the light-sensitive material or the second processing material, the light-sensitive material and the second processing material are superposed so that the light-sensitive layer and the processing layer can face to each other, and these materials are heated preferably at a temperature of from 40 to 100° C. for from 5 to 60 seconds.

The amount and the kind of water, the method of supplying water and the method of superposing the light-sensitive material on the processing material may be the same as those described with respect to the first processing material.

More specifically, the bleaching/fixing sheet described in JP-A-59-136733, U.S. Pat. No. 4,124,398 and JP-A-55-28098 may be used.

The light-sensitive material may use various surface active agents as a coating aid or for the purpose of improving releasability, improving slipperiness, preventing electrification or accelerating development. Specific examples of the surface active agent are described in Kochi Gijutu (Known Techniques), No. 5, pages 136 to 138, Aztec Limited (March 22, 1991), JP-A-62-173463 and JP-A-62-183457.

The light-sensitive material may contain an organic fluoro compound for the purpose of preventing slipperiness, inhibiting electrification or improving releasability. Representative examples of the organic fluoro compound include fluorine-base surface active agents described in JP-B-57-9053 (columns 8 to 17), JP-A-61-20944 and JP-A-62-135826, and hydrophobic fluorine compounds such as an oily fluorine-base compound (e.g., fluorine oil) and a solid fluorine compound resin (e.g., tetraethylene fluoride resin).

The light-sensitive material preferably has slipperiness. A slipping agent-containing layer is preferably provided on both the light-sensitive layer surface and the back surface. The slipperiness is preferably, in terms of coefficient of dynamic friction, from 0.01 to 0.25. This value is determined by transporting the light-sensitive material at a speed of 60 cm/min (25° C., 60% RH) against a stainless steel ball having a diameter of 5 mm. In this evaluation, even when the other party is changed to the light-sensitive layer surface, the value almost on the same level is obtained.

Examples of the slipping agent which can be used include polyorganosiloxane, a higher fatty acid amide, a higher fatty acid metal salt and an ester of a higher fatty acid with a higher alcohol. Examples of the polyorganosiloxane include polydimethylsiloxane, polydiethylsiloxane, polystyrylmethylsiloxane and polymethylphenylsiloxane. The layer to which the slipping agent is added is preferably an outermost layer of the emulsion layer or a back layer. In particular, polydimethylsiloxane and an ester having a long chain alkyl group are preferred.

In the present invention, an antistatic agent is preferably used. Examples of the antistatic agent include a carboxylic acid, a carboxylate, a polymer containing sulfonate, a cationic polymer and ionic surface active agent compound.

Most preferred antistatic agents are a fine particle of at least one crystalline metal oxide having a volume resistivity of $10^7$ Ω·cm or less, more preferably $10^5$ Ω·cm or less, and a particle size of from 0.001 to 1.0 μm, selected from ZnO, $TiO_2$, $SnO_2$, $Al_2O_3$, $In_2O_3$, $SiO_2$, MgO, BaO, $MoO_3$ and $V_2O_5$ or of a composite oxide thereof (e.g., Sb, P, B, In, S, Si, C) and a fine particle of a sol-like metal oxide or of a composite oxide thereof. The content of the antistatic agent in the light-sensitive material is preferably from 5 to 500 mg/m$^2$, more preferably from 10 to 350 mg/m$^2$. The weight ratio of the electrically conductive crystalline oxide or a composite oxide thereof to the binder is preferably from 1/300 to 100/1, more preferably from 1/100 to 100/5.

In the construction (including a back layer) of the light-sensitive material or the processing sheet, various polymer latexes may be contained for the purpose of improving physical properties of the layer, such as dimensional stabilization or prevention of curling, adhesion, cracking of layers or reduction/increase in sensitivity due to pressure. Specific examples of the polymer latex include those described in JP-A-62-245258, JP-A-62-136648 and JP-A-62-110066. In particular, when a polymer latex having a low glass transition point (40° C. or lower) is used in a mordant layer, cracking of the mordant layer can be prevented, whereas when a polymer latex having a high glass transition point is used in a back layer, a curl-preventing effect can be provided.

The light-sensitive material of the present invention preferably contains a matting agent. The matting agent may be used either on the emulsion surface or the back surface, but it is particularly preferably added to the outermost layer on the emulsion layer side. The matting agent may be either soluble in the processing solution or insoluble in the processing solution, and both are preferably used in combination. Preferred examples thereof include polymethyl methacrylate, poly(methyl methacrylate/methacrylic acid=9/1 or 5/5 (by mol)) and polystyrene particles. The particle size is preferably from 0.8 to 10 μm, the particle size distribution is preferably narrower, and 90% by number or more of all particles have a size between 0.9 and 1.1 times the average particle size. In order to increase the matting property, fine particles of 0.8 μm or less are preferably added at the same time and examples thereof include polymethyl methacrylate (0.2 μm), poly(methyl methacrylate/methacrylic acid=9/1 (by mol), 0.3 μm), polystyrene particles (0.25 μm) and colloidal silica (0.03 μm).

Specific examples of the matting agent include the compounds described in JP-A-61-88256 (page (29)), the compounds described in JP-A-63-274944 and JP-A-63-274952, such as benzoguanamine resin beads, polycarbonate resin beads and AS resin beads, and the compounds described in the above-described Research Disclosure.

In the present invention, the light-sensitive material and the processing sheet each uses a support capable of withstanding the processing temperature. In general, a photographic support such as paper and synthetic polymer (film) described in Nippon Shashin Gakkai (compiler), Shashin Kogaku no Kiso -Gin'en Sashin Hen- (Primary Study of Photographic Engineering -Silver Salt Photograph-), pages (223) to (240), Corona Sha (1979) is used. Specific examples thereof includes polyethylene terephthalate, polyethylene naphthalate, polycarbonates, polyvinyl chloride, polystyrene, polypropylene, polyimide and celluloses (e.g., triacetyl cellulose).

These each may be used alone or may be used as a support laminated on one surface or both surfaces thereof by a synthetic polymer such as polyethylene.

In addition, supports described in JP-A-62-253159 (pages (29) to (31)), JP-A-1-161236 (pages (14) to (17)), JP-A-63-316848, JP-A-2-22651, JP-A-3-56955 and U.S. Pat. No. 5,001,033 may also be used.

In the case where requirement for heat durability or curling property is severe, the supports described in JP-A-6-41281, JP-A-6-43581, JP-A-6-51426, JP-A-6-51437, JP-A-6-51442 and Japanese Patent Application Nos. 4-251845 (JP-A-6-82961), 4-231825 (JP-A-6-82960), 4-253545 (JP-A-6-123937), 4-258828 (JP-A-6-82959), 4-240122 (JP-A-6-67346), 4-221538 (U.S. Pat. No. 5326689), 5-21625 (JP-A-6-266050), 5-15926 (JP-A-6-202277), 4-331928 (JP-A-6-175282), 5-199704 (U.S. Pat. No. 5326689), 6-13455 (JP-A-7-219129) and 6-14666 (JP-A-7-219144) may be preferably used as the support for the light-sensitive material.

A support of a styrene-base polymer mainly having a syndiotactic structure may also be preferably used.

Surface treatment is preferably performed so that the support can be bonded to the light-sensitive constituent layer. Examples thereof include surface activation treatment such as chemical treatment, mechanical treatment, corona discharge treatment, flame treatment, ultraviolet light treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment.

The undercoating method is described below. The undercoat layer may comprise a single layer or two or more layers. The binder for the undercoat layer includes a copolymer starting from a monomer selected from vinyl chloride, vinylidene chloride, butadiene, methacrylic acid, acrylic acid, itaconic acid and maleic anhydride, and in addition, polyethyleneimine, epoxy resin, grafted gelatin, nitrocellulose and gelatin. The compound which swells the support include resorcinol and p-chlorophenol. The undercoat layer may contain a gelatin hardening agent and examples thereof include chromium salts (e.g., chromium alum), aldehydes (e.g., formaldehyde, glutaraldehyde), isocyanates, active halogen compounds (e.g., 2,4-dichloro-6-hydroxy-s-triazine), epichlorohydrin resins and active vinyl sulfone compounds. Further, the undercoat layer may contain $SiO_2$, $TiO_2$, an inorganic fine particle or a polymethyl methacrylate copolymer fine particle (0.01 to 10 $\mu$m) as a matting agent.

A support having a magnetic recording layer described, for example, in JP-A-4-124645, JP-A-5-40321, JP-A-6-35092 and Japanese Patent Application No. 5-106979 (JP-A-6-317875) is preferably used to record photographing information or the like.

The magnetic recording layer is provided by coating an aqueous or organic solvent-base coating solution containing a binder having dispersed therein magnetic particles, on a support.

The magnetic particle which can be used includes ferromagnetic iron oxide (e.g., $\gamma Fe_2O_3$), Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-doped ferromagnetic iron oxide such as Co-doped $\gamma Fe_2O_3$ is preferred. The shape of the magnetic particle may be any of acicular, rice grain-like, spherical, cubic and platy forms. The specific surface area as SBET is preferably 20 $m^2/g$ or more, more preferably 30 $m^2/g$ or more. The saturation magnetization ($\sigma s$) of the ferromagnetic material is preferably from $3.0\times10^4$ to $3.0\times10^5$ A/m, more preferably from $4.0\times10^4$ to $2.0\times10^5$ A/m. The ferromagnetic particle may be subjected to surface treatment with silica and/or alumina or with an organic material. Further, the magnetic particle may be subjected to surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture thereof described in JP-A-4-219569. The above-described resin has a Tg of from −40° C. to 300° C. and a weight average molecular weight of from 2,000 to 1,000,000. Examples of the resin include a vinyl-base copolymer, a cellulose derivative such as cellulose diacetate, cellulose triacetate, cellulose acetate propionate, cellulose acetate butyrate and cellulose tripropionate, an acrylic resin and a polyvinyl acetal resin, and gelatin is also preferably used. Among these, cellulose di(tri)acetate is preferred. The binder may be cured by adding thereto an epoxy-base, aziridine-base or isocyanate-base crosslinking agent. Examples of the isocyanate-base crosslinking agent include isocyanates such as tolylenediisocyanate, 4,4'-diphenylmethanediisocyanate, hexamethylenediisocyanate and xylylenediisocyanate, a reaction product of the isocyanate described above with polyalcohol (e.g., a reaction product of 3 mol of tolylenediisocyanate with 1 mol of trimethylolpropane) and a polyisocyanate produced by condensation of these isocyanates, which are described, for example, in JP-A-6-59357.

The magnetic material is dispersed in the above-described binder by the method preferably using a kneader, a pin-type mill or an annular-type mill as described in JP-A-6-35092 and these may also be preferably used in combination. The dispersant described in JP-A-5-088283 and other known dipersants may be used. The thickness of the magnetic recording layer is from 0.1 to 10 $\mu$m, preferably from 0.2 to 5 $\mu$m, more preferably from 0.3 to 3 $\mu$m. The weight ratio of the magnetic particle to the binder is preferably from 0.5:100 to 60:100, more preferably from 1:100 to 30:100. The coating amount of magnetic particles is from 0.005 to 3 $g/m^2$, preferably from 0.01 to 2 $g/m^2$, more preferably from 0.02 to 0.5 g $m^2$. The magnetic recording layer preferably has a transmission yellow density of from 0.01 to 0.50, more preferably from 0.03 to 0.20, still more preferably from 0.04 to 0.15. The magnetic recording layer may be provided throughout the surface of or stripedly on the back surface of the photographic support by coating or printing. The magnetic recording layer can be coated by using air doctor, blade, air knife, squeeze, impregnation, reverse roller, transfer roller, gravure, kiss, cast, spray, dip, bar or extrusion, and the coating solution described in JP-A-5-341436 is preferred.

The magnetic recording layer may be designed to have functions such as improvement of lubricity, control of curl, prevention of electrification, inhibition of adhesion or head abrasion, or other functional layers may be provided to undertake these functions. At least one or more of particles is preferably an abrasive of an aspheric inorganic particle having a Mhos' hardness of 5 or more. The composition of the aspheric inorganic particle is preferably an oxide such as aluminum oxide, chromium oxide, silicon dioxide or titanium dioxide, a carbide such as silicon carbide or titanium carbide, or a fine particle of diamond. The abrasive may be subjected to surface treatment with a silane coupling agent or a titanium coupling agent. The particle may be added to a magnetic recording layer or may be overcoated on the magnetic recording layer (for example, as a protective layer or a lubricant layer). The binder used here may be one selected from those described above and it is preferably the same as the binder in the magnetic recording layer. The light-sensitive material having a magnetic recording layer is described in U.S. Pat. Nos. 5,336,589, 5,250,404, 5,229,259 and 5,215,874 and European Patent 466130.

The polyester support which is preferably used in a light-sensitive material having the above-described magnetic recording layer is described below, however, details including the light-sensitive material, the processing, the cartridge and the experimental examples are described in JIII Journal of Technical Disclosure No. 94-6023, Japan Institute of Invention and Innovation (Mar. 15, 1994). The polyester is formed using a diol and an aromatic dicarboxylic acid as essential components. Examples of the aromatic dicarboxylic acid include 2,6-naphthalene dicarboxylic acid, 1,5-naphthalene dicarboxylic acid, 1,4-naphthalene dicarboxylic acid, 2,7-naphthalene dicarboxylic acid, terephthalic acid, isophthalic acid and phthalic acid, and examples of the diol include diethylene glycol, triethylene glycol, cyclohexanedimethanol, bisphenol A and bisphenol. The polymer includes a homopolymer such as polyethylene terephthalate, polyethylene naphthalate and polycyclohexanedimethanol terephthalate. Among these, preferred is a polyester containing from 50 to 100 mol % of 2,6-naphthalenedicarboxylic acid. Particularly preferred is polyethylene 2,6-naphthalate. The average molecular weight is approximately from 5,000 to 200,000. The polyester preferably has a Tg of 50° C. or higher, more preferably 90° C. or higher.

The polyester support is subjected to heat treatment to become difficult of having curling habit, at a heat treatment temperature of from 40° C. to less than the Tg, more preferably from (Tg −20° C.) to less than the Tg. The heat treatment may be performed either at a constant temperature within the above-described range or while cooling. The heat treatment time is from 0.1 to 1,500 hours, more preferably from 0.5 to 200 hours. The support may be subjected to heat treatment either in the roll state or as a web on the way of conveyance. The surface may be made uneven (for example, by coating electrically conductive inorganic fine particles such as $SnO_2$ or $Sb_2O_5$) to improve the surface state. Also, it is preferred to make some designs such that the edge is knurled to slightly increase the height only of the edge, thereby preventing the cut copy at the core portion. The heat treatment may be performed at any stage, such as after formation of support film, after surface treatment, after coating of a back layer (e.g., antistatic agent, slipping agent), or after undercoating. The preferred stage is after coating of an antistatic agent.

Into the polyester, an ultraviolet absorbent may be kneaded in. Or, for preventing light piping, a commercially available dye or pigment for polyester, such as Diaresin produced by Mitsubishi Chemicals Industries, Ltd. or Kayaset produced by Nippon Kayaku K.K., may be mixed so as to attain the object.

The film patrone into which the light-sensitive material can be loaded is described below. The patrone for use in the present invention may be mainly made of a metal or a synthetic plastic.

Preferred plastic materials are polystyrene, polyethylene, polypropylene and polyphenyl ether. The patrone may further contain various antistatic agents and preferred examples thereof include carbon black, a metal oxide particle, a nonionic, anionic, cationic or betaine surface active agent and a polymer. The patrone imparted with the antistatic property is described in JP-A-1-312537 and JP-A-1-312538. In particular, the resistance at 25° C. and 25% RH is preferably $10^{12}$ Ω or less. Usually, the plastic patrone is produced using a plastic having kneaded therein carbon black or a pigment so as to give light-shielding property. The patrone may have a 135 size currently used but it is also effective for achieving miniaturization of a camera to reduce the cartridge size from 25 mm in the current 135 size to 22 mm or less. The volume of the patrone case is preferably 30 $cm^3$ or less, more preferably 25 $cm^3$ or less. The weight of plastics used in the patrone and the patrone case is preferably from 5 to 15 g.

A patrone which delivers the film by rotation of a spool may also be used. Further, the patrone may have such a structure that a film leading end is housed in the patrone body and the film leading end is delivered from the port part of the patrone towards the outside by rotating the spool shaft in the film delivery direction. These are disclosed in U.S. Pat. Nos. 4,834,306 and 5,226,613.

For producing a print on a color paper or a heat-developable light-sensitive material using the above-described color photographing material, the methods described in JP-A-5-241251, JP-A-5-19364 and JP-A-5-19363 may be used.

The present invention will be described in greater detail below with reference to Examples but the present invention should not be construed as being limited to these Examples.

EXAMPLE 1

Preparation of Emulsion A-1:

Into a reaction vessel, 1,000 ml of distilled water containing 21.2 g of gelatin having an average molecular weight of 15,000, 0.85 g of sodium chloride and 3.8 ml of sulfuric acid (1N) was charged, and the temperature was raised to 40° C. To the resulting solution, 30 ml of an aqueous solution containing 6.1 g of silver nitrate and 30 ml of an aqueous solution containing 2.00 g of sodium chloride and 0.21 g of potassium bromide were added while vigorously stirring over 45 seconds. Subsequently, 40 ml of an aqueous solution containing 0.55 g of potassium bromide was added. Further, 100 ml of an aqueous solution containing 18.3 g of silver nitrate and 100 ml of an aqueous solution containing 6.30 g of sodium chloride were added over 3 minutes. Then, 6.0 ml of sodium hydroxide (1N) was added and the temperature of the reaction solution was elevated to 75° C. After adding thereto 10.0 g of gelatin together with 100 ml of distilled water, 750 ml of an aqueous solution containing 145.4 g of silver nitrate and a 7.0% aqueous solution of sodium chloride were added over 45 minutes while accelerating the addition flow rate and at the same time, keeping the silver potential in the reaction solution at 120 mV to the saturation calomel electrode. Then, 0.04 mg of potassium iridate hexachloride was added, and after keeping the solution at 75° C. for 30 minutes, the temperature was lowered and desalting was performed according to a usual method.

The resulting emulsion was an emulsion comprising silver chlorobromide having a silver bromide content of 0.64%, which was a tabular grain having an average grain size in terms of a sphere-corresponding diameter of 0.69 μm, a ratio obtained by dividing the diameter of a circle having the same area with the average grain projected area by the average grain thickness of 7.1, and a rectangular shape with the average adjacent major face (projection plane) edge ratios (average length/width ratio of the projection plane) being 1:1.25. This emulsion was designated as Emulsion A-1.

Preparation of Emulsion A-2:

Into a reaction vessel, 1,000 ml of distilled water containing 30.0 g of gelatin, 3.4 g of sodium chloride and 20.0 ml of sulfuric acid (1N) was charged, and the temperature was raised to 55° C. To the resulting solution, 1.7 ml of an aqueous solution of N,N'-dimethylimidazolidine-2-thione (1%) was added and then, 2,000 ml of an aqueous solution containing 7.1 g of silver nitrate and 200 ml of an aqueous solution containing 2.41 g of sodium chloride were added while vigorously stirring over 24 minutes. Subsequently, 500 ml of an aqueous solution containing 162.8 g of silver nitrate and 500 ml of an aqueous solution containing 59.88 g of sodium chloride and 0.76 g of potassium bromide were added while accelerating the addition flow rate over 80 minutes. After 60 minutes from initiation of the addition of these reaction solutions, 0.04 mg of potassium iridate hexachloride was added. After completion of the addition of the reaction solution, the solution was kept at 55° C. for 5 minutes, then the temperature was lowered and desalting was performed according to a usual method.

The resulting emulsion was an emulsion comprising silver chloride having a silver bromide content of 0.64%, which was a cubic grain having an average grain size in terms of a sphere-corresponding diameter of 0.69 μm. This emulsion was designated as Emulsion A-2.

Preparation of Emulsion A-3:

Into a reaction vessel, 930 ml of distilled water containing 0.74 g of gelatin having an average molecular weight of 15,000 and 0.7 g of potassium bromide was charged, and the temperature was raised to 40° C. To the resulting solution, 30 ml of an aqueous solution containing 1.2 g of silver nitrate and 30 ml of an aqueous solution containing 0.82 g of potassium bromide were added while vigorously stirring over 30 seconds. After completion of the addition, the solution was kept at 40° C. for 1 minute and then the temperature of the reaction solution was elevated to 75° C. After adding thereto 27.0 g of gelatin together with 200 ml of distilled water, 100 ml of an aqueous solution containing 22.5 g of silver nitrate and 80 ml of an aqueous solution containing 15.43 g of potassium bromide were added over 11 minutes while accelerating the addition flow rate. Subsequently, 250 ml of an aqueous solution containing 75.1 g of silver nitrate and an aqueous solution (concentration of potassium bromide: 26%) containing potassium iodide and potassium bromide at a molar ratio of 3:97 were added over 20 minutes while accelerating the addition flow rate and at the same time, keeping the silver potential in the reaction solution at −20 mV to the saturation calomel electrode. Further, 75 ml of an aqueous solution containing 18.7 g of silver nitrate and a 21.9% aqueous solution of potassium bromide were added over 3 minutes while keeping the silver potential in the reaction solution at −40 mV to the saturation calomel electrode. After completion of the addition, the solution was kept at 75° C. or 1 minute and the temperature of the reaction solution was lowered to 55° C. Thereafter, 120 ml of an aqueous solution containing 8.1 g of silver nitrate and 320 ml of an aqueous solution containing 7.26 g of potassium iodide were added over 5 minutes. After completion of the addition, 5.5 g of potassium bromide and 0.04 mg of potassium iridate hexachloride were added. Then, after keeping the solution at 55° C. for 1 minute, 180 ml of an aqueous solution containing 44.3 g of silver nitrate and 160 ml of an aqueous solution containing 34.0 g of potassium bromide were added over 8 minutes. Thereafter, the temperature was lowered and desalting was performed according to a usual method.

The resulting emulsion was an emulsion comprising silver iodobromide having a silver chloride content of 5.7%, which was a hexagonal tabular grain having an average grain size in terms of a sphere-corresponding diameter of 0.66 μm and a ratio obtained by dividing the average grain diameter by the average grain thickness of 7.1. This emulsion was designated as Emulsion A-3.

Each of these emulsions was subjected to spectral sensitization and chemical sensitization by adding spectral sensitizing dyes shown below, Compound I shown below, potassium thiocyanate, chloroauric acid and sodium thiosulfate. At this time, the spectral sensitizing dye was changed in proportion to the grain surface area of each emulsion. Further, the pAg at the chemical sensitization and the amount of the chemical sensitizer was adjusted to give an optimal chemical sensitization degree.

The thus-prepared green-sensitive emulsions each was expressed with a suffix of g, for example, A-1g, A-2g or A-3g.

Sensitizing Dye I for Green-Sensitive Emulsion:

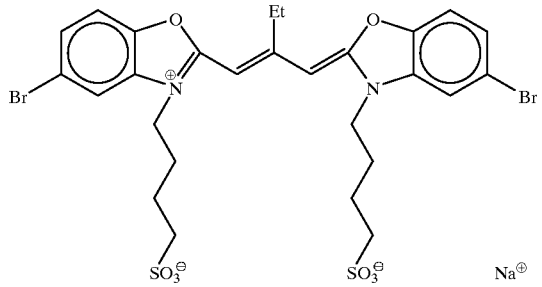

$8.4 \times 10^{-4}$ mol/mol-Ag for Emulsion B-2

Sensitizing Dye II for Green-Sensitive Emulsion:

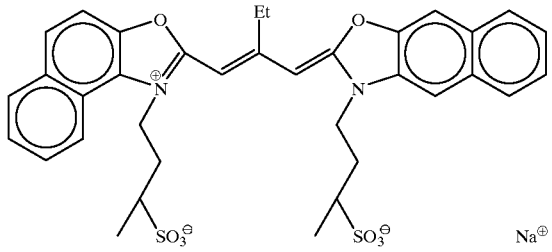

$2.2 \times 10^{-4}$ mol/mol-Ag for Emulsion B-2

Sensitizing Dye III for Green-Sensitive Emulsion:

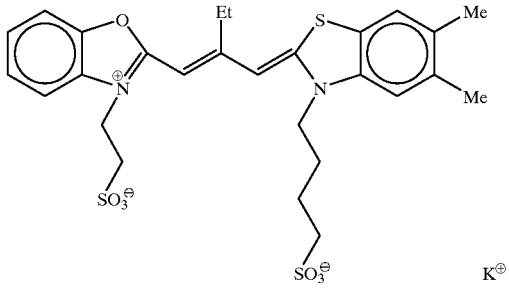

$3.2 \times 10^{-5}$ mol/mol-Ag for Emulsion B-2

Compound I:

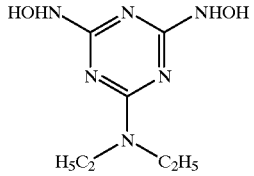

Then, a dispersion of zinc hydroxide to be used as a base precursor was prepared.

Zinc hydroxide powder (31 g) having a primary grain size of 0.2 μm, 1.6 g of carboxymethyl cellulose and 0.4 g of sodium polyacrylate as dispersants, 8.5 g of lime-processed ossein gelatin and 158.5 ml of water were mixed and the mixture was dispersed in a mill using glass beads for 1 hour. After the dispersion, glass beads were separated by filtration and 188 g of a zinc hydroxide dispersion was obtained.

An emulsion dispersion of a magenta coupler was prepared.

Magenta Coupler (a) (7.80 g), 5.45 g of Developing Agent (b), 2 mg of Antifoggant (c), 8.21 g of High Boiling Point Organic Solvent (d) and 24.0 ml of ethyl acetate were dissolved at 60° C. The resulting solution was mixed into 150 g of an aqueous solution having dissolved therein 12.0 g of lime-processed gelatin and 0.6 g of Surface Active Agent (e) and the mixture was emulsion dispersed using a dissolver at a revolution of 10,000 for 20 minutes. After the emulsion dispersion, distilled water was added to make the total amount of 300 g and mixed at a revolution of 2,000 for 10 minutes.

Magenta Coupler (a)

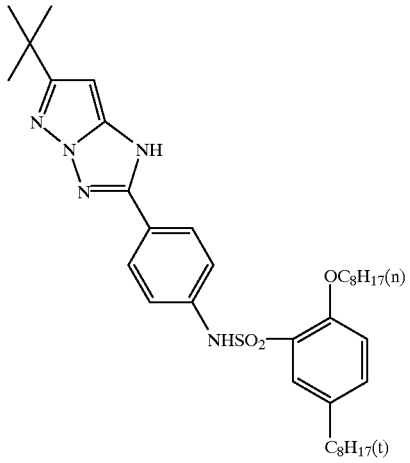

Developing Agent (b)

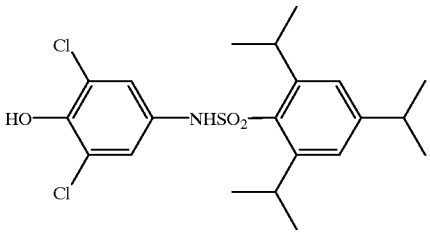

Antifoggant (c)

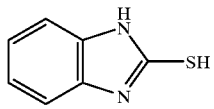

High Boiling Point Organic Solvent (d)

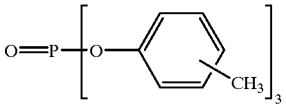

Surface Active Agent (e)

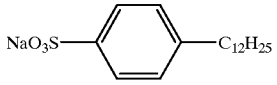

By combining these dispersions with the silver halide emulsions prepared above, solutions having a composition shown in Table 1 each was coated on a support to prepare 3 kinds of heat developable color photographic light-sensitive material Samples 101 to 103.

TABLE 1

| | | Sample (mg/m$^2$) | | |
|---|---|---|---|---|
| | | 101 | 102 | 103 |
| Protective Layer | Lime-processed gelatin | 1,000 | 1,000 | 1,000 |
| | Matting agent (silica) | 50 | 50 | 50 |
| | Surface Active Agent (f) | 100 | 100 | 100 |
| | Surface Active Agent (g) | 300 | 300 | 300 |
| | Water-Soluble Polymer (h) | 15 | 15 | 15 |
| | Hardening Agent (i) | | | |
| Interlayer | Lime-processed gelatin | 375 | 375 | 375 |
| | Surface Active Agent (g) | 15 | 15 | 15 |
| | Zinc hydroxide | 1,100 | 1,100 | 1,100 |
| | Water Soluble Polymer (h) | 15 | 15 | 15 |
| Magenta Coloring Layer | Lime-processed gelatin | 2,000 | 2,000 | 2,000 |
| | Emulsion (in terms of coated silver amount) | A-1g 1,726 | A-2g 1,726 | A-3g 1,726 |
| | Magenta Coupler (a) | 637 | 637 | 637 |
| | Developing Agent (b) | 444 | 444 | 444 |
| | Antifoggant (c) | 0.20 | 0.20 | 0.20 |
| | High Boiling Point Organic Solvent (d) | 670 | 670 | 670 |
| | Surface Active Agent (e) | 33 | 33 | 33 |
| | Water-Soluble Polymer (h) | 14 | 14 | 14 |
| Transparent PET base (120 $\mu$m) | | | | |

Surface Active Agent (f)

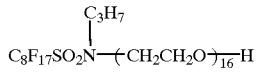

Surface Active Agent (g)

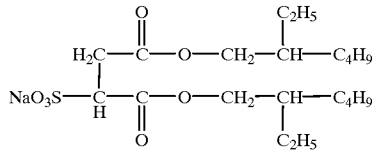

Water Soluble Polymer (h)

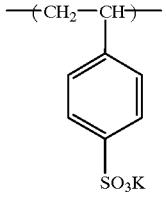

Hardening Agent (i)

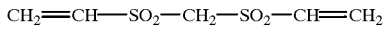

Further, Processing Materials P-1 and P-2 as shown in Tables 2-1, 2-2 and 3 was prepared.

TABLE 2-1

Construction of Processing Material P-1

| Layer Structure | Materials | Addition Amount (mg/m$^2$) |
|---|---|---|
| Fourth Layer (Protective Layer) | Acid-processed gelatin | 220 |
| | Water Soluble Polymer (j) | 60 |
| | Water Soluble Polymer (k) | 200 |
| | Additive (l) | 80 |
| | Palladium sulfide | 3 |
| | Potassium nitrate | 12 |
| | Matting Agent (m) | 10 |
| | Surface Active Agent (g) | 7 |

TABLE 2-1-continued

Construction of Processing Material P-1

| Layer Structure | Materials | Addition Amount (mg/m$^2$) |
|---|---|---|
| | Surface Active Agent (n) | 7 |
| | Surface Active Agent (o) | 10 |
| Third Layer (Interlayer) | Lime-processed gelatin | 240 |
| | Water-Soluble Polymer (k) | 24 |
| | Hardening Agent (p) | 180 |
| | Surface Active Agent (e) | 9 |
| Second Layer (Base generating Layer) | Lime-processed gelatin | 2,400 |
| | Water-Soluble Polymer (k) | 360 |
| | Water-Soluble Polymer (q) | 700 |
| | Water-Soluble Polymer (r) | 600 |
| | High Boiling Point Solvent (s) | 2,000 |
| | Additive (t) | 20 |
| | Potassium hydantoin | 260 |
| | Guanidine picolinate | 2,910 |
| | Potassium quinolinate | 225 |
| | Sodium quinolinate | 180 |
| | Surface Active Agent (e) | 24 |
| First Layer (Undercoat Layer) | Lime-processed gelatin | 280 |
| | Water-Soluble Polymer (j) | 12 |
| | Surface Active Agent (g) | 14 |
| | Hardening Agent (p) | 185 |
| Transparent Support A (63 μm) | | |

TABLE 2-2

Construction of Processing Material P-2

| Layer Structure | Materials | Addition Amount (mg/m$^2$) |
|---|---|---|
| Fourth Layer | Acid-processed gelatin | 180 |
| | Water Soluble Polymer (j) | 60 |
| | Water Soluble Polymer (k) | 200 |
| | Potassium nitrate | 12 |
| | Matting Agent (m) | 10 |
| | Surface Active Agent (g) | 7 |
| | Surface Active Agent (n) | 7 |
| | Surface Active Agent (o) | 10 |
| Third Layer | Lime-processed gelatin | 240 |
| | Water-Soluble Polymer (k) | 24 |
| | Hardening Agent (p) | 180 |
| | Surface Active Agent (e) | 9 |
| Second Layer | Lime-processed gelatin | 2,400 |
| | Water-Soluble Polymer (k) | 120 |
| | Water-Soluble Polymer (q) | 700 |
| | Water-Soluble Polymer (r) | 600 |
| | High Boiling Point Solvent (s) | 2,000 |
| | Additive A | 1,270 |
| | Additive B | 683 |
| | Surface Active Agent (e) | 20 |
| First Layer | Gelatin | 190 |
| | Water-Soluble Polymer (j) | 12 |
| | Surface Active Agent (g) | 14 |
| | Hardening Agent (p) | 185 |
| Transparent Support A (63 μm) | | |

TABLE 3

Construction of Support A

| Name of Layer | Composition | Weight (mg/m$^2$) |
|---|---|---|
| Surface Undercoat Layer | Gelatin | 100 |
| Polymer Layer | Polyethylene terephthalate | 62,500 |
| Back Surface Undercoat Layer | Methyl methacrylate-styrene-2-ethylhexyl acrylate-methacrylic acid copolymer | 1,000 |
| | PMMA latex (average particle size: 12 μm) | 120 |
| | | 63,720 |

Water-Soluble Polymer (j)
κ-carrageenan

Water-Soluble Polymer (k)
SUMIKAGEL L-5H (produced by Sumitomo Chemical Company, Limited)

Additive (1)

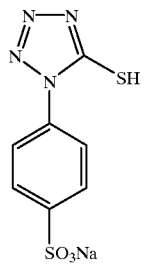

Matting Agent (m)

SYLOID79 (produced by Fuji Davison)

Surface Active Agent (n)

Surface Active Agent (O)

TABLE 3-continued

Construction of Support A

| Name of Layer | Composition | Weight ($mg/m^2$) |
|---|---|---|
| | 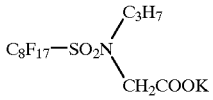 | 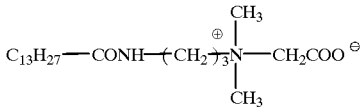 |
| Hardening Agent (p) | | Water-Soluble Polymer (q) |
| 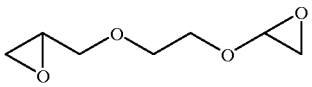 | | Dextran (molecular weight: 70,000) |
| Water-Soluble Polymer (r)<br>MP polymer MP102 (produced by Kuraray KK)<br>High Boiling Point Solvent (s)<br>EN-PARA 40 (produced by Ajinomoto KK)<br>Additive (t) | | |
| 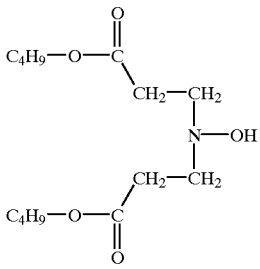 | | |
| Additive A | | |
| 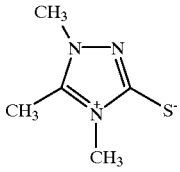 | | |
| Additive B | | |
| 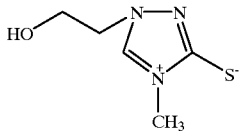 | | |

Each of these light-sensitive materials was exposed through an optical wedge and a green filter at 1,000 lux for 1/100 second.

After the exposure, 15 $ml/m^2$ (corresponding to 60% of water necessary for giving maximum swelling of the light-sensitive material and the processing material) of warm water at 40° C. was applied to the surface of each light-sensitive material, the light-sensitive material was laminated on the processing material (Processing Material P-1) such that the layer surfaces faced to each other, and the laminate was heat developed at 83° C. for 15 seconds using a heat drum. After the processing, the light-sensitive material was peeled off and a magenta colored wedgewise image was obtained.

Each sample was subjected to the second stage processing using a second processing sheet described below. In the second stage processing, 10 $ml/m^2$ of water was coated on a second processing sheet (Processing Material P-2), the sheet was laminated on the light-sensitive material after the first processing, and the laminate was heated at 60° C. for 30 seconds.

These colored samples each was measured on the transmission density and a so-called characteristic curve was obtained. A reciprocal of the exposure amount necessary for giving a density 0.15 higher than the fog density was used as a relative sensitivity and the sensitivity was shown by a value relative to the value of Sample 101 taken as 100. The maximum coloring density was used as an index for developing property. Further, a logarithm of the difference between the exposure amount necessary for giving a density 0.1 higher than the fog density and the exposure amount corresponding to the density 0.2 lower than the maximum density was used as a latitude.

Then, each sample was examined on the granularity. Each sample was exposed to give a magenta coloring density of 1.0 and heat-developed in the same manner as above to prepare a colored specimen, and the RMS granularity was measured through an aperture having a diameter of 48 $\mu$m using a diffuse light source.

For comparison with conventional liquid development, the same exposed samples each was processed using Processing CN-16 for a color negative film under the development conditions of 38° C. and 185 seconds, and these were measured on the RMS granularity in the same manner.

The results obtained are shown in Table 4.

TABLE 4

| | Sample | | |
|---|---|---|---|
| | 101 | 102 | 103 |
| Sensitivity | 100 | 48 | 87 |
| Maximum density | 3.06 | 3.21 | 2.67 |
| Latitude | 2.12 | 1.24 | 1.51 |
| RMS granularity | | | |
| Heat development | 0.016 | 0.018 | 0.012 |
| CN-16 Processing | 0.034 | 0.036 | 0.021 |

It is seen from the results obtained above that on comparison between Sample 101 and 102, wide exposure latitude and high sensitivity can be obtained by using the emulsion of the present invention. In Sample 103 using a silver iodobromide emulsion, coloring is insufficient and sensitivity is low within a short development time of 15 seconds. Accordingly, by using the silver halide emulsion and the image formation method of the present invention, an image can be obtained within by far a short time as compared with the conventional development method and at the same time, outstandingly good graininess can be achieved.

EXAMPLE 2

The following emulsions different in the average grain size and the aspect ratio were prepared by changing the reaction temperature, the addition rate of reaction solutions and the addition amount of potassium bromide in the preparation of Emulsion A-1.

| Emulsion | Average Grain Size ($\mu$m) | Average Aspect Ratio | Length/Width Ratio of Projection plane |
|---|---|---|---|
| A-1 | 0.69 | 7.1 | 1:1.25 |
| A-4 | 0.69 | 5.4 | 1:1.32 |
| A-5 | 0.69 | 3.7 | 1:1.41 |
| B-1 | 0.38 | 5.4 | 1:1.28 |
| B-2 | 0.38 | 3.7 | 1:1.36 |
| B-3 | 0.38 | 2.2 | 1:1.45 |
| C-1 | 0.87 | 7.1 | 1:1.24 |
| C-2 | 0.87 | 5.4 | 1:1.31 |
| C-3 | 0.87 | 3.7 | 1:1.40 |

Each of these emulsions was subjected to spectral sensitization and chemical sensitization in the same manner as in Example 1 and shown with a suffix of g.

By combining each of these emulsions with the dispersion prepared in Example 1, 10 kinds of light-sensitive material Samples 201 to 210 shown in Table 5 were prepared. The relation between the average projected area and the coated grain number of silver halide grains coated on the light-sensitive material is shown in Table 6.

TABLE 5

| | | Sample (mg/m$^2$) | | | | | | | | | |
|---|---|---|---|---|---|---|---|---|---|---|---|
| | | 201 | 202 | 203 | 204 | 205 | 206 | 207 | 208 | 209 | 210 |
| Protective Layer | Lime-processed gelatin | 1,000 | 1,000 | 1,000 | 1,000 | 1,000 | 1,000 | 1,000 | 1,000 | 1,000 | 1,000 |
| | Matting agent (silica) | 50 | 50 | 50 | 50 | 50 | 50 | 50 | 50 | 50 | 50 |
| | Surface Active Agent (f) | 100 | 100 | 100 | 100 | 100 | 100 | 100 | 100 | 100 | 100 |
| | Surface Active Agent (g) | 300 | 300 | 300 | 300 | 300 | 300 | 300 | 300 | 300 | 300 |
| | Water-Soluble Polymer (h) | 15 | 15 | 15 | 15 | 15 | 15 | 15 | 15 | 15 | 15 |
| | Hardening Agent (i) | | | | | | | | | | |
| Interlayer | Lime-processed gelatin | 375 | 375 | 375 | 375 | 375 | 375 | 375 | 375 | 275 | 375 |
| | Surface Active Agent (g) | 15 | 15 | 15 | 15 | 15 | 15 | 15 | 15 | 15 | 15 |
| | Zinc hydroxide | 1,100 | 1,100 | 1,100 | 1,100 | 1,100 | 1,100 | 1,100 | 1,100 | 1,100 | 1,100 |
| | Water Soluble Polymer (h) | 15 | 15 | 15 | 15 | 15 | 15 | 15 | 15 | 15 | 15 |
| Magenta Coloring Layer | Lime-processed gelatin | 2,000 | 2,000 | 2,000 | 2,000 | 2,000 | 2,000 | 500 | 500 | 500 | 150 |
| | Emulsion (in terms of coated silver amount) | B-2g<br>863 | B-2g<br>1,726 | B-2g<br>4,315 | A-4g<br>863 | A-4g<br>1,726 | A-4g<br>4,315 | A-4g<br>1,079 | A-4g<br>1,079 | A-1g<br>1,079 | C-1g<br>647 |
| | Magenta Coupler (a) | 637 | 637 | 637 | 637 | 637 | 637 | 159 | 159 | 159 | 48 |

TABLE 5-continued

| | | Sample (mg/m$^2$) | | | | | | | | | |
|---|---|---|---|---|---|---|---|---|---|---|---|
| | | 201 | 202 | 203 | 204 | 205 | 206 | 207 | 208 | 209 | 210 |
| | Developing Agent (b) | 444 | 444 | 444 | 444 | 444 | 444 | 111 | 111 | 111 | 33 |
| | Antifoggant (c) | 0.20 | 0.20 | 0.20 | 0.20 | 0.20 | 0.20 | 0.05 | 0.05 | 0.05 | 0.02 |
| | High Boiling Point organic Solvent (d) | 670 | 670 | 670 | 670 | 670 | 670 | 168 | 168 | 168 | 50 |
| | Surface Active Agent (e) | 33 | 33 | 33 | 33 | 33 | 33 | 8 | 8 | 8 | 3 |
| | Water-Soluble Polymer (h) | 14 | 14 | 14 | 14 | 14 | 14 | 4 | 4 | 4 | 1 |
| Magenta Coloring Layer | Lime-processed gelatin | — | — | — | — | — | — | 1,500 | 1,500 | 1,500 | 220 |
| | Emulsion | — | — | — | — | — | — | B-2g 647 | B-1g 647 | B-1g 647 | A-4g 475 |
| | Magenta Coupler (a) | — | — | — | — | — | — | 477 | 477 | 477 | 70 |
| | Developing Agent (b) | — | — | — | — | — | — | 333 | 333 | 333 | 49 |
| | Antifoggant (c) | — | — | — | — | — | — | 0.15 | 0.15 | 0.15 | 0.02 |
| | High Boiling Point Organic Solvent (d) | — | — | — | — | — | — | 504 | 504 | 504 | 74 |
| | Surface Active Agent (e) | — | — | — | — | — | — | 24 | 24 | 24 | 4 |
| | Water-Soluble Polymer (h) | — | — | — | — | — | — | 12 | 12 | 12 | 2 |
| Magenta Coloring Layer | Lime-processed gelatin | — | — | — | — | — | — | — | — | — | 1,400 |
| | Emulsion | — | — | — | — | — | — | — | — | — | B-2g 604 |
| | Magenta Coupler (a) | — | — | — | — | — | — | — | — | — | 446 |
| | Developing Agent (b) | — | — | — | — | — | — | — | — | — | 311 |
| | Antifoggant (c) | — | — | — | — | — | — | — | — | — | 0.14 |
| | High Boiling Point organic Solvent (d) | — | — | — | — | — | — | — | — | — | 469 |
| | Surface Active Agent (e) | — | — | — | — | — | — | — | — | — | 23 |
| | Water-Soluble Polymer (h) | — | — | — | — | — | — | — | — | — | 10 |

Transparent PET base (120 $\mu$m)

TABLE 6

| | Sample | | | | | | | | | |
|---|---|---|---|---|---|---|---|---|---|---|
| | 201 | 202 | 203 | 204 | 205 | 206 | 207 | 208 | 209 | 210 |
| Used emulsion-1 | B-2 | B-2 | B-2 | A-4 | A-4 | A-4 | B-2 | B-1 | B-1 | B-2 |
| Average projected area ($\mu$m$^2$) | 0.2070 | 0.2070 | 0.2070 | 0.8783 | 0.8783 | 0.8783 | 0.2070 | 0.2664 | 0.2664 | 0.2070 |
| Coated silver amount (g/m$^2$) | 0.8630 | 1.7260 | 4.3150 | 0.8630 | 1.7260 | *4.3150 | 0.6470 | 0.6470 | 0.6470 | 0.6040 |
| Grain number ($\times 10^{12}$/m$^2$) | 7.1780 | 14.3560 | 35.8900 | 1.1990 | 2.3979 | 5.9948 | 5.3814 | 5.3814 | 5.3814 | 5.0237 |
| Used emulsion-2 | — | — | — | — | — | — | A-4 | A-4 | A-1 | A-4 |
| Average projected area ($\mu$m$^2$) | | | | | | | 0.8783 | 0.8783 | 1.0541 | 0.8783 |
| Coated silver amount (g/m$^2$) | | | | | | | 1.0790 | 1.0790 | 1.0790 | 0.4750 |
| Grain number ($\times 10^{12}$/m$^2$) | | | | | | | 1.4990 | 1.4990 | 1.4990 | 0.6599 |
| Used emulsion-3 | — | — | — | — | — | — | — | — | — | C-1 |
| Average projected area ($\mu$m$^2$) | | | | | | | | | | 1.6795 |
| Coated silver amount (g/m$^2$) | | | | | | | | | | 0.6470 |
| Grain number ($\times 10^{12}$/m$^2$) | | | | | | | | | | 0.4484 |

TABLE 6-continued

| | Sample | | | | | | | | | |
|---|---|---|---|---|---|---|---|---|---|---|
| | 201 | 202 | 203 | 204 | 205 | 206 | 207 | 208 | 209 | 210 |
| Ratio* specified in the present invention | — | — | — | — | — | — | 1/0.1923 | 1/0.2786 | 1/0.2119 | 1/0.0900/ 0.0465 |
| Ratio of grain numbers | — | — | — | — | — | — | 1/0.2786 | 1/0.2786 | 1/0.2786 | 1/0.1314/ 0.0893 |

In Table 6, * means the ratio of the values obtained by dividing the coated silver amount by the 3/2nd power of average grain projected area (hereinafter the same).

Each of these light-sensitive materials was tested on the photographic properties in the same manner as in Example 1. The results obtained are shown in Table 7.

Furthermore, coloring agent dispersions were also prepared by combining Yellow Colored Leuco Dye (X), Magenta Colored Leuco Dye (Z) or Leuco Dye (ab) with a zinc complex for the purpose of forming a colored layer capable of decoloration at the time of heat development processing.

TABLE 7

| | Sample | | | | | | | | | |
|---|---|---|---|---|---|---|---|---|---|---|
| | 201 | 202 | 203 | 204 | 205 | 206 | 207 | 208 | 209 | 210 |
| Sensitivity | 100 | 121 | 110 | 325 | 398 | 346 | 380 | 397 | 465 | 798 |
| Maximum density | 2.76 | 3.15 | 3.29 | 2.42 | 3.02 | 3.12 | 3.07 | 3.09 | 3.11 | 3.15 |
| Latitude | 1.91 | 1.85 | 1.78 | 2.16 | 2.08 | 2.04 | 2.36 | 2.21 | 2.49 | 3.39 |
| RMS granularity | | | | | | | | | | |
| Heat development | 0.013 | 0.012 | 0.012 | 0.017 | 0.016 | 0.014 | 0.013 | 0.015 | 0.012 | 0.012 |
| CN-16 Processing | 0.028 | 0.026 | 0.025 | 0.036 | 0.035 | 0.033 | 0.032 | 0.034 | 0.031 | 0.033 |

On reviewing the data of Samples 207 to 210 using two kinds of emulsions different in the average grain size, samples where as the emulsion having a larger average grain projected area, the ratio of silver halide grain numbers per unit area of the present invention is larger than the ratio of the values obtained by dividing the coated silver amount of emulsion by the 3/2nd power of average grain projected area, provide good results. In other words, Samples 207, 209 and 210 achieve high sensitivity, wide latitude and excellent granularity. Sample 208 where the above-described ratios are equal has a relatively large granularity and a relatively narrow latitude.

Further, when the development step CN-16 for a conventional negative film is used, the effects of the present invention cannot be obtained, and they can first be provided when the heat development specified in the present invention is performed. These effects cannot be expected at all from known techniques and are very surprising discovery.

EXAMPLE 3

Blue-sensitive emulsions and red-sensitive emulsions were prepared by changing the spectral sensitizing dyes used in spectral sensitization of the silver halide emulsions prepared in Examples 1 and 2.

Further, a cyan coupler dispersion and a yellow coupler dispersion were prepared according to the preparation method of a coupler dispersion in Example 1.

Sensitizing Dye IV for Blue-Sensitive Emulsion:

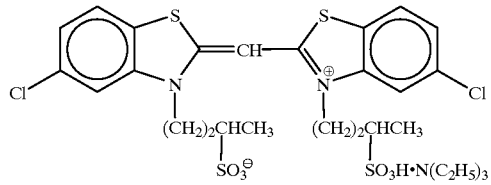

$6.0 \times 10^{-4}$ mol/mol-Ag for Emulsion B-2

Sensitizing Dye V for Red-Sensitive Emulsion:

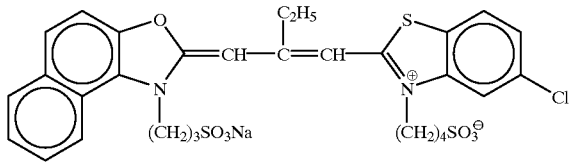

$3.5 \times 10^{-4}$ mol/mol-Ag for Emulsion B-2

Sensitizing Dye VI for Red-Sensitive Emulsion:

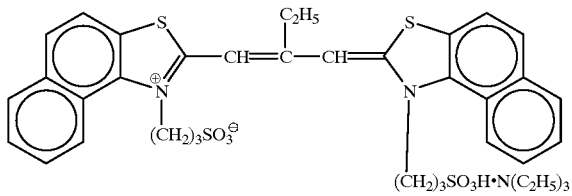

$1.6 \times 10^{-5}$ mol/mol-Ag for Emulsion B-2

-continued

Sensitizing Dye VII for Red-Sensitive Emulsion:

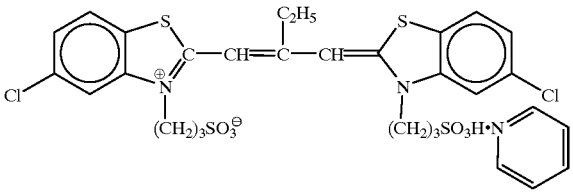

$5.1 \times 10^{-4}$ mol/mol-Ag for Emulsion B-2

Yellow Coupler (u)

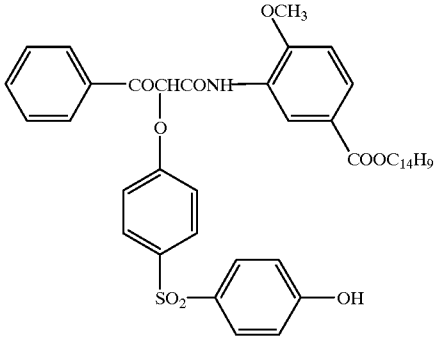

Developing Agent (v)

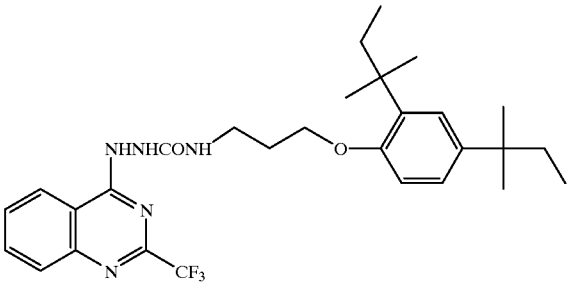

Antifoggant (w)

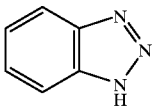

Cyan Coupler (aa)

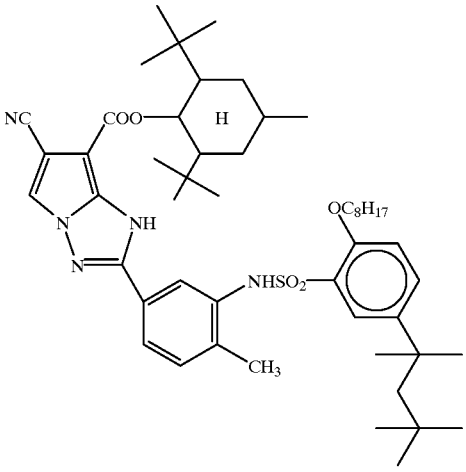

-continued

Leuco Dye (ab)

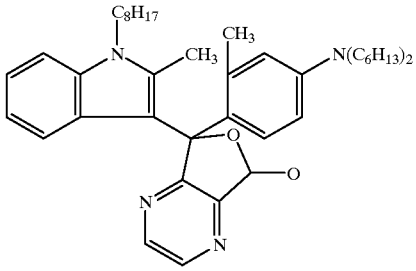

Yellow Colored Leuco Dye (X)

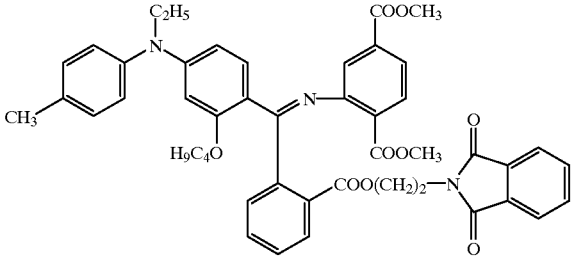

Developer (Y)

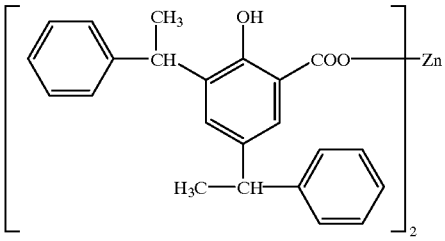

Magenta Colored Leuco Dye (Z)

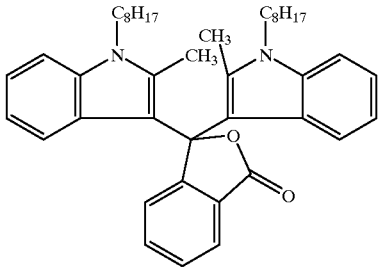

Using the thus-obtained silver halide emulsions, coupler dispersions and coloring agent dispersions, heat-developable color light-sensitive materials having a multi-layer structure shown in Table 8, Table 9 and Table 10 were prepared.

TABLES 8 to 10

Construction of Heat Developable Color Light-Sensitive Material

| | | Sample | | | |
|---|---|---|---|---|---|
| | | 301 | 302 | 303 | 304 |
| Protective Layer | Lime-processed gelatin | 1,000 | 1,000 | 1,000 | 1,000 |
| | Matting agent | 50 | 50 | 50 | 50 |

TABLES 8 to 10-continued

Construction of Heat Developable Color Light-Sensitive Material

| | | Sample 301 | 302 | 303 | 304 |
|---|---|---|---|---|---|
| | (silica) | | | | |
| | Surface Active Agent (f) | 100 | 100 | 100 | 100 |
| | Surface Active Agent (g) | 300 | 300 | 300 | 300 |
| | Water-Soluble Polymer (h) | 15 | 15 | 15 | 15 |
| | Hardening Agent (i) | 98 | 98 | 98 | 91 |
| Interlayer | Lime-processed gelatin | 375 | 375 | 375 | 375 |
| | Surface Active Agent (g) | 15 | 15 | 15 | 15 |
| | Zinc hydroxide | 1,100 | 1,100 | 1,100 | 1,100 |
| | Water Soluble Polymer (h) | 15 | 15 | 15 | 15 |
| Yellow Coloring Layer | Lime-processed gelatin | 2,000 | 2,000 | 500 | 150 |
| | Emulsion (in terms of coated silver amount) | A-3b 1,726 | A-1b 1,726 | A-1b 1,079 | C-1b 647 |
| | Yellow Coupler (u) | 760 | 760 | 190 | 57 |
| | Developing Agent (v) | 546 | 546 | 137 | 41 |
| | Antifoggant (w) | 57 | 57 | 14 | 4 |
| | High Boiling Point Organic Solvent (d) | 670 | 670 | 168 | 50 |
| | Surface Active Agent (e) | 33 | 33 | 8 | 3 |
| | Water-Soluble Polymer (h) | 14 | 14 | 4 | 1 |
| Yellow Coloring Layer | Lime-processed gelatin | — | — | 1,500 | 220 |
| | Emulsion (in terms of coated silver amount) | — | — | B-1b 647 | A-4b 475 |
| | Yellow Coupler (u) | — | — | 570 | 84 |
| | Developing Agent (v) | — | — | 410 | 60 |
| | Antifoggant (w) | — | — | 43 | 6 |
| | High Boiling Point Solvent (d) | — | — | 503 | 74 |
| | Surface Active Agent (e) | — | — | 24 | 4 |
| | Water Soluble Polymer (h) | — | — | 12 | 2 |
| Yellow Coloring Layer | Lime-processed gelatin | — | — | — | 1,400 |
| | Emulsion (in terms of coated silver amount) | — | — | — | B-2b 604 |
| | Yellow Coupler (u) | — | — | — | 532 |
| | Developing Agent (v) | — | — | — | 382 |
| | Antifoggant (w) | — | — | — | 40 |
| | High Boiling Point Organic Solvent (d) | — | — | — | 469 |
| | Surface Active Agent (e) | — | — | — | 23 |
| | Water-Soluble Polymer (h) | — | — | — | 10 |
| Interlayer | Lime-processed gelatin | 750 | 750 | 750 | 750 |
| | Surface Active Agent (e) | 15 | 15 | 15 | 15 |
| | Leuco Dye (X) | 303 | 303 | 303 | 303 |

TABLES 8 to 10-continued

Construction of Heat Developable Color Light-Sensitive Material

| | | Sample 301 | 302 | 303 | 304 |
|---|---|---|---|---|---|
| | Developer (Y) | 433 | 433 | 433 | 433 |
| | Water-Soluble Polymer (h) | 15 | 15 | 15 | 15 |
| Magenta Coloring Layer | Lime-processed gelatin | 2,000 | 500 | 500 | 150 |
| | Emulsion (in terms of coated silver amount) | A-3g 1,726 | A-1g 1,726 | A-1g 1,079 | C-1g 647 |
| | Magenta Coupler (a) | 637 | 637 | 159 | 48 |
| | Developing Agent (b) | 444 | 444 | 111 | 33 |
| | Antifoggant (c) | 0.20 | 0.20 | 0.05 | 0.02 |
| | High Boiling Point Organic Solvent (d) | 670 | 670 | 168 | 50 |
| | Surface Active Agent (e) | 33 | 33 | 8 | 3 |
| | Water-Soluble Polymer (h) | 14 | 14 | 4 | 1 |
| Magenta Coloring Layer | Lime-processed gelatin | — | — | 1,500 | 220 |
| | Emulsion | — | — | B-1g 647 | A-4g 475 |
| | Magenta Coupler (a) | — | — | 477 | 70 |
| | Developing Agent (b) | — | — | 333 | 49 |
| | Antifoggant (c) | — | — | 0.15 | 0.02 |
| | High Boiling Point Solvent (d) | — | — | 504 | 74 |
| | Surface Active Agent (e) | — | — | 24 | 4 |
| | Water-Soluble Polymer (h) | — | — | 12 | 2 |
| Magenta Coloring Layer | Lime-processed gelatin | — | — | — | 1,400 |
| | Emulsion | — | — | — | B-2g 604 |
| | Magenta Coupler (a) | — | — | — | 446 |
| | Developing Agent (b) | — | — | — | 311 |
| | Antifoggant (c) | — | — | — | 0.14 |
| | High Boiling Point Organic Solvent (d) | — | — | — | 469 |
| | Surface Active Agent (e) | — | — | — | 23 |
| | Water-Soluble Polymer (h) | — | — | — | 10 |
| Interlayer | Lime-processed gelatin | 900 | 900 | 900 | 900 |
| | Surface Active Agent (e) | 15 | 15 | 15 | 15 |
| | Leuco Dye (Z) | 345 | 345 | 345 | 345 |
| | Developer (Y) | 636 | 636 | 636 | 636 |
| | Zinc hydroxide | 1,100 | 1,100 | 1,100 | 1,100 |
| | Water-Soluble Polymer (h) | 15 | 15 | 15 | 15 |
| Cyan Coloring Layer | Lime-processed gelatin | 2,000 | 2,000 | 500 | 150 |
| | Emulsion | A-3r 1,726 | A-1r 1,726 | A-1r 1,079 | C-1r 647 |
| | Cyan Coupler (aa) | 872 | 872 | 218 | 65 |
| | Developing Agent (b) | 444 | 444 | 111 | 33 |
| | Antifoggant (c) | 0.45 | 0.45 | 0.11 | 0.03 |
| | High Boiling Point Organic | 670 | 670 | 168 | 50 |

TABLES 8 to 10-continued

| Construction of Heat Developable Color Light-Sensitive Material | | Sample | | | |
|---|---|---|---|---|---|
| | | 301 | 302 | 303 | 304 |
| | Solvent (d) | | | | |
| | Surface Active Agent (e) | 33 | 33 | 8 | 3 |
| | Water-Soluble Polymer (h) | 14 | 14 | 4 | 1 |
| Cyan Coloring Layer | Lime-processed gelatin | — | | 1,500 | 220 |
| | Emulsion | — | — | B-1r 647 | A-4r 475 |
| | Cyan Coupler (aa) | — | — | 654 | 96 |
| | Developing Agent (b) | — | — | 333 | 49 |
| | Antifoggant (c) | — | — | 0.34 | 0.05 |
| | High Boiling Point Solvent (d) | — | — | 504 | 74 |
| | Surface Active Agent (e) | — | — | 24 | 4 |
| | Water-Soluble Polymer (h) | — | — | 12 | 2 |
| Cyan Coloring Layer | Lime-processed gelatin | — | — | — | 1,400 |
| | Emulsion | — | — | — | B-2r 604 |
| | Cyan Coupler (aa) | — | — | — | 610 |
| | Developing Agent (b) | — | — | — | 311 |
| | Antifoggant (c) | — | — | — | 0.32 |
| | High Boiling Point Organic Solvent (d) | — | — | — | 469 |
| | Surface Active Agent (e) | — | — | — | 23 |
| | Water-Soluble Polymer (h) | — | — | — | 10 |
| Anti-halation Layer | Lime-processed gelatin | 750 | 750 | 750 | 750 |
| | Surface Active Agent (e) | 15 | 15 | 15 | 15 |
| | Leuco Dye (ab) | 243 | 243 | 243 | 243 |
| | Developer (Y) | 425 | 425 | 425 | 425 |
| | Water-Soluble Polymer (h) | 15 | 15 | 15 | 15 |
| Transparent PET base (120 μm) | | | | | |

Each of these light-sensitive materials was tested on the photographic property in the same manner as in Example 1. First, each light-sensitive material was exposed through an optical wedge and a blue, green or red filter at 1,000 lux for 1/100 second.

After the exposure, 15 ml/m$^2$ of warm water at 40° C. was applied to the surface of each light-sensitive material, the light-sensitive material was laminated on the processing material used. in Example 1 such that the layer surfaces faced to each other, and the laminate was heat developed at 83° C. for 15 seconds using a heat drum. After the processing, the light-sensitive material was peeled off and then, a yellow colored wedgewise image was obtained on the sample exposed through a blue filter, a magenta colored wedgewise image on the sample exposed through a green filter, and a cyan colored wedgewise image on the sample exposed through a red filter. These colored samples each was measured on the transmission density and characteristic values were obtained in the same manner as in Example 1. The sensitivity was shown by a relative value to the sensitivity of Sample 301 to blue, green or red, taken as 100.

Then, each sample was examined on the granularity. Each sample was exposed to give a yellow, magenta or cyan coloring density of 1.0 and heat-developed in the same manner as above to prepare a colored specimen, and the RMS granularity was measured through an aperture having a diameter of 48 μm using a diffuse light source.

For comparison with conventional liquid development, the same exposed samples each was processed using Processing CN-16 for a color negative film under the development conditions of 38° C. and 185 seconds, and these were measured on the RMS granularity in the same manner.

The relation of the coated grain numbers of silver halide in these light-sensitive materials is shown in Table 11 and the results obtained are shown in Table 12.

TABLE 11

| | Sample | | | |
|---|---|---|---|---|
| | 301 | 302 | 303 | 304 |
| Blue-Sensitive Layer: | | | | |
| Used emulsion-1 | A-3b | A-1b | B-1b | B-2b |
| Average projected area (μm$^2$) | 0.9645 | 1.0541 | 0.2664 | 0.2070 |
| Coated silver amount (g/m$^2$) | 1.7260 | 1.7260 | 0.6470 | 0.6040 |
| Grain number (× 10$^{12}$/m$^2$) | 3.1513 | 2.3978 | 5.3814 | 5.0237 |
| Used emulsion-2 | — | — | A-1b | A-4b |
| Average projected area (μm$^2$) | | | 1.0541 | 0.8783 |
| Coated silver amount (g/m$^2$) | | | 1.0790 | 0.4750 |
| Grain number (× 10$^{12}$/m$^2$) | | | 1.4990 | 0.6599 |
| Used emulsion-3 | — | — | — | C-1b |
| Average projected area (μm$^2$) | | | | 1.6759 |
| Coated silver amount (g/m$^2$) | | | | 0.6470 |
| Grain number (× 10$^{12}$/m$^2$) | | | | 0.4484 |
| Ratio* specified in the present invention | — | — | 1/0.2119 | 1/0.0900/ 0.0465 |
| Ratio of grain numbers | — | — | 1/0.2786 | 1/0.1314/ 0.0893 |
| Green-Sensitive Layer: | | | | |
| Used emulsion-1 | A-3g | A-1g | B-1g | B-2g |
| Average projected area (μm$^2$) | 0.9645 | 1.0541 | 0.2664 | 0.2070 |
| Coated silver amount (g/m$^2$) | 1.7260 | 1.7260 | 0.6470 | 0.6040 |
| Grain number (× 10$^{12}$/m$^2$) | 3.1513 | 2.3978 | 5.3814 | 5.0237 |
| Used emulsion-2 | — | — | A-1g | A-4g |
| Average projected area (μm$^2$) | | | 1.0541 | 0.8783 |
| Coated silver amount (g/m$^2$) | | | 1.0790 | 0.4750 |
| Grain number (× 10$^{12}$/m$^2$) | | | 1.4990 | 0.6599 |
| Used emulsion-3 | — | — | — | C-1g |
| Average projected area (μm$^2$) | | | | 1.6759 |
| Coated silver amount (g/m$^2$) | | | | 0.6470 |
| Grain number (× 10$^{12}$/m$^2$) | | | | 0.4484 |

TABLE 11-continued

| | Sample | | | |
|---|---|---|---|---|
| | 301 | 302 | 303 | 304 |
| Ratio* specified in the present invention | — | — | 1/0.2119 | 1/0.0900/ 0.0465 |
| Ratio of grain numbers | — | — | 1/0.2786 | 1/0.1314/ 0.0893 |
| Red-Sensitive Layer | | | | |
| Used emulsion-1 | A-3r | A-1r | B-1r | B-2r |
| Average projected area ($\mu m^2$) | 0.9645 | 1.0541 | 0.2664 | 0.2070 |
| Coated silver amount ($g/m^2$) | 1.7260 | 1.7260 | 0.6470 | 0.6040 |
| Grain number ($\times 10^{12}/m^2$) | 3.1513 | 2.3978 | 5.3814 | 5.0237 |
| Used emulsion-2 | — | — | A-1r | A-4r |
| Average projected area ($\mu m^2$) | | | 1.0541 | 0.8783 |
| Coated silver amount ($g/m^2$) | | | 1.0790 | 0.4750 |
| Grain number ($\times 10^{12}/m^2$) | | | 1.4990 | 0.6599 |
| Used emulsion-3 | — | — | — | C-1r |
| Average projected area ($\mu m^2$) | | | | 1.6759 |
| Coated silver amount ($g/m^2$) | | | | 0.6470 |
| Grain number ($\times 10^{12}/m^2$) | | | | 0.4484 |
| Ratio* specified in the present invention | — | — | 1/0.2119 | 1/0.0900/ 0.0465 |
| Ratio of grain numbers | — | — | 1/0.2786 | 1/0.1314/ 0.0893 |

From the results obtained above, the effects of the present invention can be apparently seen. More specifically, Sample 302 using the high silver chloride emulsion of the present invention can achieve excellent coloring property even in heat development within a short time. At this time, the graininess is by far excellent as compared with the case where a processing solution for a usual negative film was used. Further, Samples 303 and 304 having a silver halide coated grain number within the ratio of the present invention exhibits further excellent graininess and wide exposure latitude.

EXAMPLE 4

Light-sensitive materials were prepared in the same manner as the multi-layer color light-sensitive materials prepared in Example 3 except for changing the support to the support prepared as follows and subjected to the same experiment.

1) Support

The support used in this Example was prepared according to the following method.

A polyethylene-2,6-naphthalate polymer (100 parts by weight) and 2 parts by weight of TINUVIN P.326 (produced by Ciba-Geigy AG) as an ultraviolet absorbent were dried, melted at 300° C., extruded from a T-die, longitudinally stretched at 140° C. to 3.3 times, then transversely stretched at 130° C. to 3.3 times and further heat set at 250° C. for 6 seconds to obtain a PEN film having a thickness of 90 $\mu$m. To the resulting PEN film, a blue dye, a magenta dye and a yellow dye (Compounds I-1, I-4, I-6, I-24, I-26, I-27 and II-5 described in JIII Journal of Technical Disclosure, No. 94-6023) were added in an appropriate amount. Further, the film was wound around a stainless steel core having a diameter of 20 cm and imparted with heat history at 110° C. for 48 hours, thereby obtaining a support difficult to have curling habit.

2) Coating of Undercoat Layer

Both surfaces of the support obtained above were subjected to corona discharge treatment, UV discharge treatment and further glow discharge treatment, and on each surface, an undercoating solution containing 0.1 $g/m^2$ of gelatin, 0.01 $g/m^2$ of sodium $\alpha$-sulfodi-2-ethylhexylsuccinate, 0.04 $g/m^2$ of salicylic acid, 0.2 $g/m^2$ of p-chlorophenol, 0.012 $g/m^2$ of $(CH_2{=}CHSO_2CH_2CH_2NHCO)_2CH_2$ and 0.02 $g/m^2$ of a polyamide-epichlorohydrin polycondensate was coated (10 $ml/m^2$, by a bar coater) to provide an undercoat layer on the higher temperature side at the time of stretching. The drying was performed at 115° C. for 6 minutes (the rollers and the transportation device in the drying zone all were heated to 115° C.).

TABLE 12

| | Sample 301 | | | Sample 302 | | | Sample 303 | | | Sample 304 | | |
|---|---|---|---|---|---|---|---|---|---|---|---|---|
| | B | G | R | B | G | R | B | G | R | B | G | R |
| Sensitivity | 100 | 100 | 100 | 129 | 132 | 141 | 138 | 141 | 151 | 367 | 377 | 399 |
| Maximum density | 1.88 | 1.73 | 1.71 | 2.72 | 2.60 | 2.55 | 2.87 | 2.94 | 2.76 | 2.78 | 2.82 | 2.64 |
| Latitude | 1.69 | 1.71 | 1.63 | 2.05 | 1.98 | 1.96 | 2.65 | 2.73 | 2.82 | 3.66 | 3.61 | 3.56 |
| RMS granularity | | | | | | | | | | | | |
| Heat development | 0.012 | 0.013 | 0.015 | 0.015 | 0.015 | 0.016 | 0.012 | 0.013 | 0.013 | 0.012 | 0.012 | 0.013 |
| CN-16 Processing | 0.029 | 0.032 | 0.033 | 0.035 | 0.034 | 0.038 | 0.030 | 0.031 | 0.033 | 0.029 | 0.029 | 0.032 |

3) Coating of Back Layer

On one surface of the undercoated support, an antistatic layer, a magnetic recording layer and a slipping layer each having the following composition were coated as a back layer.

3-1) Coating of Antistatic Layer

Together with 0.05 $g/m^2$ of gelatin, 0.02 $g/m^2$ of $(CH_2{=}CHSO_2CH_2CH_2NHCO)_2CH_2$, 0.005 $g/m^2$ of poly (polymerization degree: 10)oxyethylene-p-nonylphenol and resorcinol, 0.2 $g/m^2$ of a dispersion (secondary coagulated particle size: about 0.08 $\mu$m) of fine particle powder having a resistivity of 5 $\Omega$·cm of a tin oxide-antimony oxide composite having an average particle diameter of 0.005 $\mu$m was coated.

3-2) Coating of Magnetic Recording Layer

Co-γ-iron oxide (0.06 g/m$^2$) (specific surface area: 43 m$^2$/g; major axis: 0.14 μm; minor axis: 0.03 μm; saturated magnetization: 89 emu/g; $Fe^{+2}/Fe^{+3}$=6/94; the surface being treated with aluminum oxide and silicon oxide each in an amount of 2 wt % based on the iron oxide) subjected to covering treatment with 3-poly(polymerization degree: 15)oxyethylene-propyloxytrimethoxysilane (15 wt %) was coated using 1.2 g/m$^2$ of diacetyl cellulose (the iron oxide being dispersed by an open kneader and a sand mill), 0.3 g/m$^2$ of $C_2H_5C(CH_2OCONH\text{-}C_6H_3(CH_3)NCO)_3$ as a hardening agent, and acetone, methyl ethyl ketone and cyclohexanone as solvents by means of a bar coater to obtain a magnetic recording layer having a thickness of 1.2 μm. Thereto, silica particles (0.3 μm) as a matting agent and an aluminum oxide (0.15 μm) covered with 3-poly(polymerization degree: 15)oxyethylene-propyloxytrimethoxysilane (15 wt %), as an abrasive, were added each to give a coverage of 10 mg/m$^2$. The drying was performed at 115° C. for 6 minutes (the rollers and the transportation device in the drying zone all were heated to 115° C). Increase in the color density of the magnetic recording layer $D^B$ with X-light (blue filter) was about 0.1, the saturated magnetization moment of the magnetic recording layer was 4.2 emu/m$^2$, the coercive force was $7.3\times10^4$ A/m and the rectangular ratio was 65%.

3-3) Preparation of Slipping Layer

Diacetyl cellulose (25 mg/m$^2$) and a mixture of $C_6H_{13}CH(OH)C_{10}OH_{21}COOC_{40}H_{81}$ (Compound a, 6 mg/m$^2$) and $C_{50}H_{101}O(CH_2CH_2O)_{16}H$ (Compound b, 9 mg/m$^2$) were coated. The mixture was prepared by melting these compounds in xylene/propylene monomethyl ether (1/1) at 105° C. and pouring and dispersing the melt in propylene monomethyl ether (10-folded amount) at room temperature, and added after formulating it into a dispersion (average particle size: 0.01 μm) in acetone. Silica particles (0.3 μm) as a matting agent and aluminum oxide (0.15 μm) covered with 3-poly(polymerization degree: 15)oxyethylene-propyloxytrimethoxysilane (15 wt %), as an abrasive, were added each to have a coverage of 15 mg/m$^2$. The drying was performed at 115° C. for 6 minutes (the rollers and the transportation device in the drying zone all were heated to 115° C). The thus-provided slipping layer had excellent properties such that the coefficient of dynamic friction was 0.06 (5-mmϕ stainless steel ball; load: 100 g; speed: 6 cm/min), the coefficient of static friction was 0.07 (by clip method) and the coefficient of dynamic friction between the emulsion surface and the slipping layer was 0.12.

The thus-prepared light-sensitive materials each was cut into a size of 24 mm (width)×160 cm, and two perforations each in a size of 2 mm×2 mm were provided on the portion of 0.7 mm inside from one vertical side in the length direction of the light-sensitive material at an interval of 5.8 mm. Samples each having this pair of perforations at an interval of 32 mm were prepared and housed in a plastic-made film cartridge shown in FIGS. 1 to 7 of U.S. Pat. No. 5,296,887.

FM signals were recorded on each sample from the surface having coated thereon a magnetic recording layer between the above-described perforations at a feeding speed of 1,000/s using a head capable of input/output having a head gap of 5 μm and a turn number of 2,000.

After recording of the FM signals, each sample was again housed in the plastic-made film cartridge where it had been housed.

The thus-prepared light-sensitive materials in cartridge were examined and as a result, similarly, good results were obtained and the effects of the present invention were verified.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material which is capable of forming a dye image comprising a first support having thereon at least one photographic light-sensitive layer comprising a light-sensitive silver halide emulsion, a developing agent, a compound capable of forming a dye upon coupling reaction with an oxidation product of the developing agent and a binder;

wherein said image is capable of being formed by (a) exposing said light sensitive material;

(b) attaching said light-sensitive material to a processing material, which material comprises a second support having thereon a base and/or a base precursor, in such a way that the coated surfaces of the two materials face each other, in the presence of a small amount of water which corresponds to from 1/10 to 1 times water necessary for giving maximum swelling of all coated layers constituting the light-sensitive material and the processing material; and then (c) heating the light-sensitive material and the processing material, wherein at least one of said at least one photographic light-sensitive layer contains an emulsion having silver halide grains having a silver chloride content of 50 mol % or more, wherein the silver halide grains are tabular grains (i) having a main outer surface constituted by (100) faces, (ii) having a rectangular shape with adjacent major face edge ratios being from 1:1 to 1:2, and (iii) having an aspect ratio of 2 or more; and wherein said developing agent is a compound represented by the following formula I or II:

I

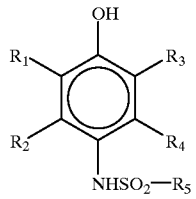

II

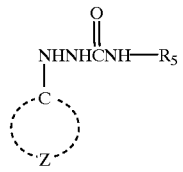

wherein $R_1$, $R_2$, $R_3$, and $R_4$ each represents a hydrogen atom, a halogen atom, an alkyl group, an aryl group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, alkylcarbonyl group, an arylcarbonyl group or an acyloxy group, $R_5$ represents an alkyl group, an aryl group or a heterocyclic group, Z represents an atomic group necessary for forming an aromatic ring or a heteroaromic ring and when Z is a benzene ring, the sum of the Hammett's constants (σ) of the substituents thereof is 1 or more, wherein the compounds represented by the formulae I and II each contain at least one ballast group having 8 or more carbon atoms so as to impart oil solubility to the molecule.

2. The silver halide color photographic light-sensitive material as claimed in claim 1, wherein at least one of said at least one photographic light-sensitive layer contains at least two silver halide emulsions having spectral sensitivity in the same wavelength region and different average grain projected area in combination, wherein said at least two silver halide emulsions are contained in separate light-sensitive layers or in the same light-sensitive layer.

* * * * *